US010626611B2

(12) United States Patent
Thrall et al.

(10) Patent No.: US 10,626,611 B2
(45) Date of Patent: Apr. 21, 2020

(54) MODULAR TRUSS JOINT

(71) Applicants: University of Notre Dame du Lac, South Bend, IN (US); HNTB Corporation, New York, NY (US)

(72) Inventors: Ashley P. Thrall, South Bend, IN (US); Mirela D. Tumbeva, South Bend, IN (US); Theodore P. Zoli, III, New York, NY (US)

(73) Assignees: University of Notre Dame du Lac, South Bend, IN (US); HNTB Corporation, New York, NY (US)

( * ) Notice: Subject to any disclaimer, the term of this patent is extended or adjusted under 35 U.S.C. 154(b) by 113 days.

(21) Appl. No.: 15/807,535

(22) Filed: Nov. 8, 2017

(65) Prior Publication Data

US 2018/0127979 A1 May 10, 2018

Related U.S. Application Data

(60) Provisional application No. 62/419,260, filed on Nov. 8, 2016, provisional application No. 62/476,587, filed
(Continued)

(51) Int. Cl.

| | |
|---|---|
| ***E04C 3/02*** | (2006.01) |
| ***E04C 3/08*** | (2006.01) |
| ***E01D 15/133*** | (2006.01) |
| ***E04B 1/24*** | (2006.01) |
| ***E04B 1/41*** | (2006.01) |
| ***E04C 3/11*** | (2006.01) |

(Continued)

(52) U.S. Cl.
CPC ..... *E04C 3/08* (2013.01); *E01D 15/133* (2013.01); *E04B 1/2403* (2013.01); *E04B 1/40* (2013.01);
(Continued)

(58) Field of Classification Search
CPC ..... E01D 6/00; E04C 3/02; E04C 3/04; E04C 2303/0404; E04C 2303/0491; E04C 2003/0404; E04C 2003/0491
(Continued)

(56) References Cited

U.S. PATENT DOCUMENTS

| | | | |
|---|---|---|---|
| 2,334 | A | 11/1841 | Cottrell |
| 118,566 | A | 8/1871 | Weimer |

(Continued)

FOREIGN PATENT DOCUMENTS

| | | | |
|---|---|---|---|
| CN | 201891069 | U | 7/2011 |
| CN | 202248251 | U | 5/2012 |
| CN | 103103929 | A | 5/2013 |

OTHER PUBLICATIONS

International Search Report and Written Opinion dated Jan. 23, 2018, nine (9) pages.

*Primary Examiner* — Gary S Hartmann
(74) *Attorney, Agent, or Firm* — Greenberg Traurig, LLP

(57) ABSTRACT

A modular truss joint is a web plate with at least three connectors. Each connection includes a web integrally formed as a portion of the web plate of a certain length. Each connection is positioned at a connector angle with respect to the other connectors. The connections have continuous flanges on a periphery of the modular truss joint. Each flange is oriented transversely to the web. The connectors form a modular structure by each connecting to at least one wide flange body to form a moment resisting connection such that the modular truss joint resists flexure of the modular structure.

27 Claims, 31 Drawing Sheets

Related U.S. Application Data on Mar. 24, 2017, provisional application No. 62/512, 761, filed on May 31, 2017.

(51) Int. Cl.
*E01D 6/00* (2006.01)
*E04C 3/04* (2006.01)

(52) U.S. Cl.
CPC ..... *E04C 3/02* (2013.01); *E04C 3/11* (2013.01); *E01D 6/00* (2013.01); *E04B 1/24* (2013.01); *E04B 2001/2415* (2013.01); *E04B 2001/2457* (2013.01); *E04B 2001/2466* (2013.01); *E04B 2103/06* (2013.01); *E04C 2003/0491* (2013.01)

(58) Field of Classification Search
USPC ..... 14/3, 4, 6, 13, 14; 52/636, 691, 693
See application file for complete search history.

(56) References Cited

U.S. PATENT DOCUMENTS

| | | | | |
|---|---|---|---|---|
| 447,422 | A | 3/1891 | Zenke | |
| 779,370 | A | 1/1905 | Miller | |
| 1,163,641 | A | 12/1915 | Cummings | |
| 1,741,423 | A * | 12/1929 | Lachman | E04C 3/086 29/415 |
| 1,962,820 | A | 6/1934 | Knight | |
| 2,559,741 | A | 7/1951 | Wachsmann | |
| 3,152,347 | A | 10/1964 | Williams | |
| 4,089,148 | A | 5/1978 | Oehmsen | |
| 4,156,433 | A | 5/1979 | Beaulieu | |
| 4,179,860 | A | 12/1979 | Reale | |
| 4,551,957 | A | 11/1985 | Madray | |
| 4,628,560 | A | 12/1986 | Clevett et al. | |
| 4,706,436 | A | 11/1987 | Mabey | |
| 4,957,186 | A | 9/1990 | Reetz | |
| 5,024,031 | A | 6/1991 | Hoberman | |
| 5,724,691 | A | 3/1998 | Wiedeck | |
| 6,553,698 | B1 | 4/2003 | Kemeny | |
| 8,621,797 | B2 * | 1/2014 | Kim | E01D 2/00 52/223.8 |
| 8,800,239 | B2 | 8/2014 | Yang | |
| 10,011,961 | B2 | 7/2018 | Bouleau | |
| 2017/0268185 | A1 * | 9/2017 | Thrall | E01D 15/133 |
| 2017/0268186 | A1 * | 9/2017 | Thrall | E01D 15/133 |
| 2018/0127979 | A1 * | 5/2018 | Thrall | E04C 3/11 |

* cited by examiner

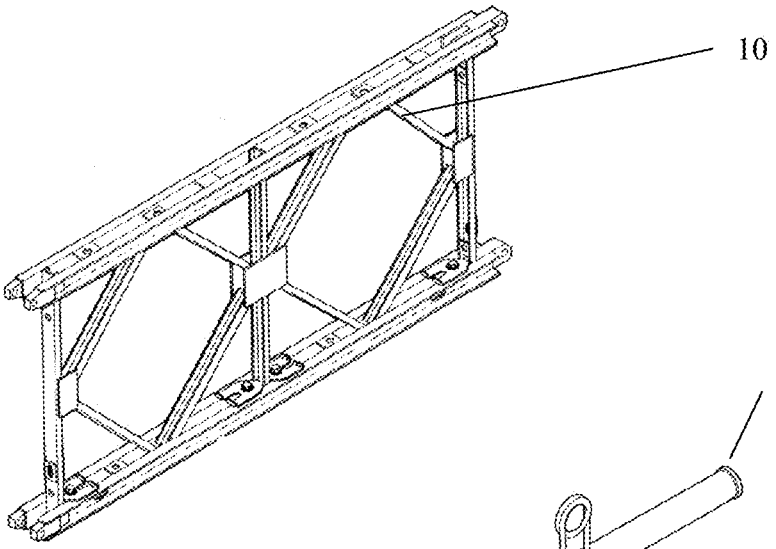
[Prior Art]
FIG. 1A
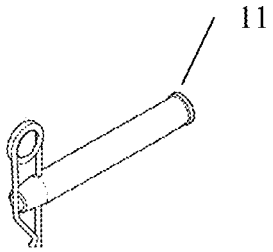
[Prior Art]
FIG. 1B
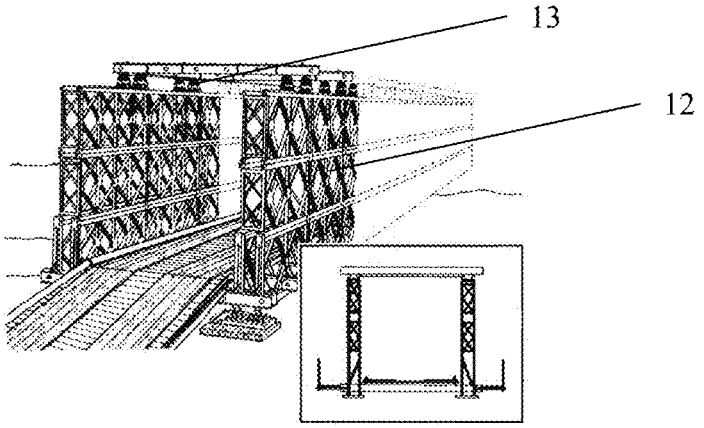
[Prior Art]
FIG. 1C
[Prior Art]
FIG. 1D

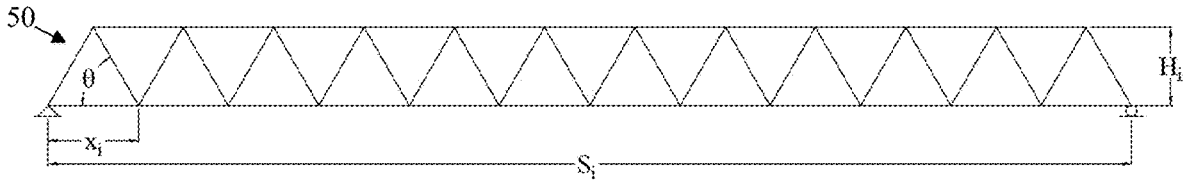
FIG. 8
| Family # | $S_1$ = 300 ft | | $S_2$ = 200 ft | | $S_3$ = 400 ft | |
|---|---|---|---|---|---|---|
| | # of Truss Joints in the Lower Chord | Horizontal Length between Truss Joints | # of Truss Joints in the Lower Chord | Horizontal Length between Truss Joints | # of Truss Joints in the Lower Chord | Horizontal Length between Truss Joints |
| | (n) | (x, ft) | (n) | (x, ft) | (n) | (x, ft) |
| 1 | 5 | 75 | 7 | 33.33 | 4 | 133.33 |
| 2 | 9 | 37.5 | 13 | 16.67 | 7 | 66.67 |
| 3 | 13 | 25 | 19 | 11.11 | 10 | 44.44 |
FIG. 9
| Span | Depth | Horizontal Length between Truss Joints | Span-to-depth Ratio |
|---|---|---|---|
| (S, ft) | (H, ft) | (x, ft) | |
| 300 | 21.65 | 25 | 13.86 |
| 200 | 9.620 | 11.11 | 20.79 |
| 400 | 38.49 | 44.44 | 10.39 |
FIG. 10
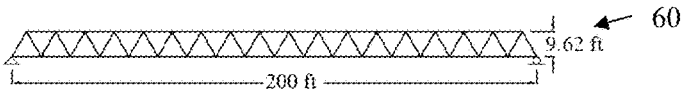
FIG. 11A
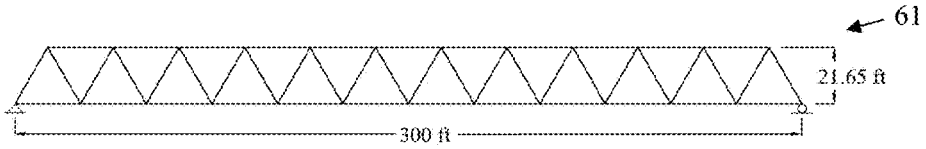
FIG. 11B
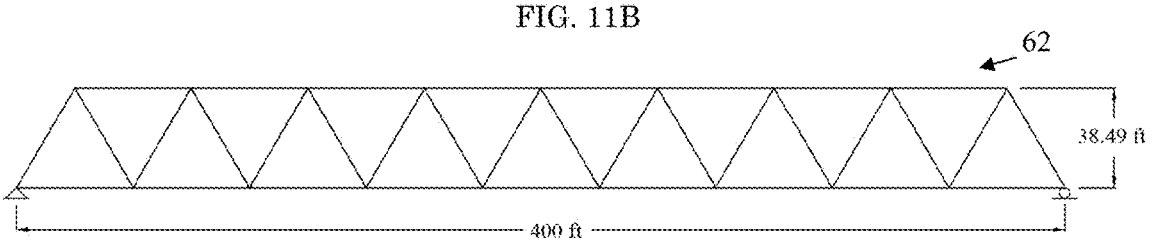
FIG. 11C

| 200 ft Simply Supported Truss | |
|---|---|
| **Member** | **Sections Sizes** |
| Lower Chord | W14x109 |
| Upper Chord | W14x109 |
| Diagonals | W14x61 |
| Transverse Floor Beams | W12x79 |
| Diagonals in Portal Region | W14x109 |
| Buckling Factor = 2.61954<br>Self-weight = 383.04 kips | |

| 300 ft Simply Supported Truss | |
|---|---|
| **Member** | **Sections Sizes** |
| Lower Chord | W14x68 |
| Upper Chord | W14x109 |
| Diagonals | W14x48 |
| Transverse Floor Beams | W8x24 |
| Diagonals in Portal Region | W14x109 |
| Transverse Lateral Bracing | W8x24 |
| X-shaped Lateral Bracing | 0.5 in. diam. Cable |
| Transverse Lateral Bracing in Portal Region | W14x109 |
| Buckling Factor = 2.64489<br>Self-weight = 513.89 kips | |

| 400 ft Simply Supported Truss | |
|---|---|
| **Member** | **Sections Sizes** |
| Lower Chord | W14x109 |
| Upper Chord | W14x132 |
| Diagonals | W14x109 |
| Transverse Floor Beams | W14x109 |
| Diagonals in Portal Region | W14x132 |
| Transverse Lateral Bracing | W14x109 |
| X-shaped Lateral Bracing | 0.5 in. diam. Cable |
| Transverse Lateral Bracing in Portal Region | W14x109 |
| Buckling Factor = 2.53241<br>Self-weight = 842.37 kips | |

| Simply Supported Truss | |
|---|---|
| **Member** | **Sections Sizes** |
| Lower Chord | W14x109 |
| Upper Chord | W14x109 |
| Diagonals | W14x109 |
| Transverse Floor Beams | W8x24 |
| Diagonals in Portal Region | W14x109 |
| Transverse Lateral Bracing | W14x109 |
| X-shaped Lateral Bracing | 0.5 in. diam. Cable |
| Transverse Lateral Bracing in Portal Region | W14x109 |
| Buckling Factor = 2.53789<br>Self-weight = 787.83 kips | |

| Three-span Continuous Truss | |
|---|---|
| **Member** | **Sections Sizes** |
| Lower Chord | W14x132 |
| Upper Chord | W14x109 |
| Diagonals | W14x109 |
| Transverse Floor Beams | W14x109 |
| Diagonals in Portal Region | W14x109 |
| Transverse Lateral Bracing | W14x109 |
| X-shaped Lateral Bracing | 0.5 in. diam. Cable |
| Transverse Lateral Bracing in Portal Region | W14x109 |
| Buckling Factor = 2.55056<br>Self-weight = 2200.92 kips | |
FIG 30C
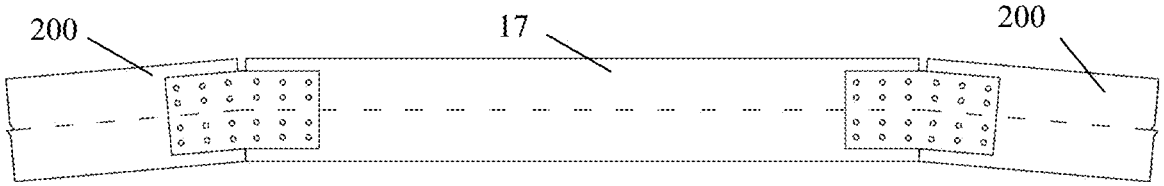
FIG 31A
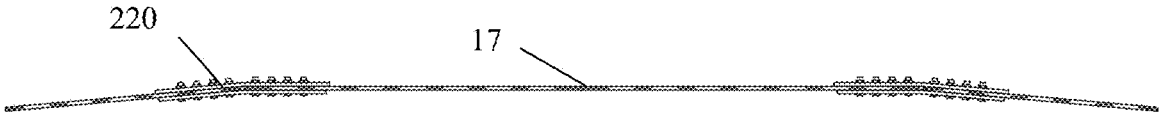
FIG 31B

MODULAR TRUSS JOINT

CROSS REFERENCE TO RELATED APPLICATION

This application is a non-provisional application claiming priority from U.S. Provisional Patent Application No. 62/419,260 entitled "Panelized Joint" filed Nov. 8, 2016; U.S. Provisional Patent Application No. 62/476,587 entitled "New Approaches to Accelerated Bridge Construction Through Adjustable Connections and Adjustable Modules" filed Mar. 24, 2017; and U.S. Provisional Patent Application No. 62/512,761 entitled "Panelized Joint" filed May 31, 2017.

GOVERNMENT LICENSE RIGHTS

This invention was made with government support under CMMI-1351272 awarded by the National Science Foundation. The government has certain rights in the invention.

FIELD OF THE DISCLOSURE

The present description relates generally to a new approach to modular construction using a modular truss joint. Example applications can include, but are not limited to, all forms of truss-type structural systems, with particular emphasis on bridge and building structural systems. This disclosure provides specific detail to example bridge applications.

BACKGROUND OF RELATED ART

Modular structures, meaning structures comprised of identical repeated components, provide significant construction advantages as components can be prefabricated and mass-produced. Modules can also be designed to be used to form many different types of structures (e.g., different depths, spans). They can also be re-used. Modular design and construction can reduce the overall project cost and project schedule. Modular approaches can be used for a wide variety of structures, including bridges and buildings.

Modular bridges are comprised of prefabricated components or panels that can be rapidly assembled on site. Existing modular or panelized steel bridging systems (e.g., Bailey, Acrow, Mabey-Johnson) consist of rigid rectangular steel panels that are connected by pins and are arranged in a longitudinal configuration to form a girder-type bridge. They have also been used in alternative configurations to construct bridge piers, suspension bridges, movable bridges, and buildings, as well as for temporary formwork or scaffolding for construction. These modular bridges were developed to serve needs in rapid construction in war, but have also been widely used in emergencies and disasters. Early attempts at modular bridging included the Callender-Hamilton Bridge which was comprised of individual steel members bolted together on site. These were later replaced by the Bailey Bridge system, and its derivatives, which featured rigid panels connected by pins that were easier and faster to erect.

These prior art systems feature rigid, rectangular modules (typically 10 ft in length, see for example a Bailey panel 10 in FIG. 1A) which are connected longitudinally (by pin connectors 11 in FIG. 1B) to form girder-type bridges. Versatility of these existing systems is achieved by stacking modules vertically and/or transversely to reach longer spans (up to 200 to 300 ft) and/or higher load capacity (see for example the double-triple configuration—meaning two modules stacked transversely and three modules stacked vertically—of a Bailey system 12 in FIG. 1C).

A primary limitation of the existing technology is that a fixed panel size limits the span length. More specifically, the span is limited by buckling. Lateral bracing 13 in FIG. 1C can be utilized between planes of stacked panels to mitigate buckling failures. However, lateral bracing is expensive and time-consuming to install. Geometric challenges also result in a stacked through-type bridge. Further, buckling failures can still occur. Additional limitations include that the pin connection between panels are less reliable than other types of connections between structural members. Also, the structural depth along the span is not varied despite varying moment and shear demand, resulting in an inefficient use of materials. Accordingly, there is a demonstrated need for an improved approach to modular construction as declared herein.

BRIEF DESCRIPTION OF THE DRAWINGS

FIG. 1A shows a prior art Bailey Bridge panel.

FIG. 1B shows a pin connector for a Bailey Bridge.

FIG. 1C is a prior art double-triple girder-type configuration of Bailey Bridge panels of FIG. 1A forming a bridge.

FIG. 1D shows the prior art double-triple girder-type Bailey Bridge of FIG. 1C in elevation view from one end.

FIG. 8 is an example elevation view of a constant-depth simply supported bridge comprised of modular truss joints and diagonal and chord beams with span $S_i$ and depth $H_i$.

FIG. 9 is a table showing potential numbers of modular truss joints in the lower chord and the horizontal length between truss joints for 200 ft, 300 ft, and 400 ft constant-depth simply supported truss bridges.

FIG. 10 is a table showing the depth, horizontal length between truss joints, and span-to-depth ratio for 200, 300 and 400 ft constant-depth simply supported truss bridges.

FIG. 11A is an elevation view of the example 200 ft constant-depth simply supported bridges.

FIG. 11B is an elevation view of the example 300 ft constant-depth simply supported bridges.

FIG. 11C is an elevation view of the example 400 ft constant-depth simply supported bridges.

FIG. 30C is a table showing the sections sizes, buckling factor, and self-weight of the example variable-depth three-span continuous truss bridge in FIG. 28.

FIG. 31A is a plan view indicating the connection of an example 4-noded modular truss joint with angled wide flange bodies.

FIG. 31B is a second plan view of the example configuration in FIG. 31A.

DETAILED DESCRIPTION

Figure 2A:
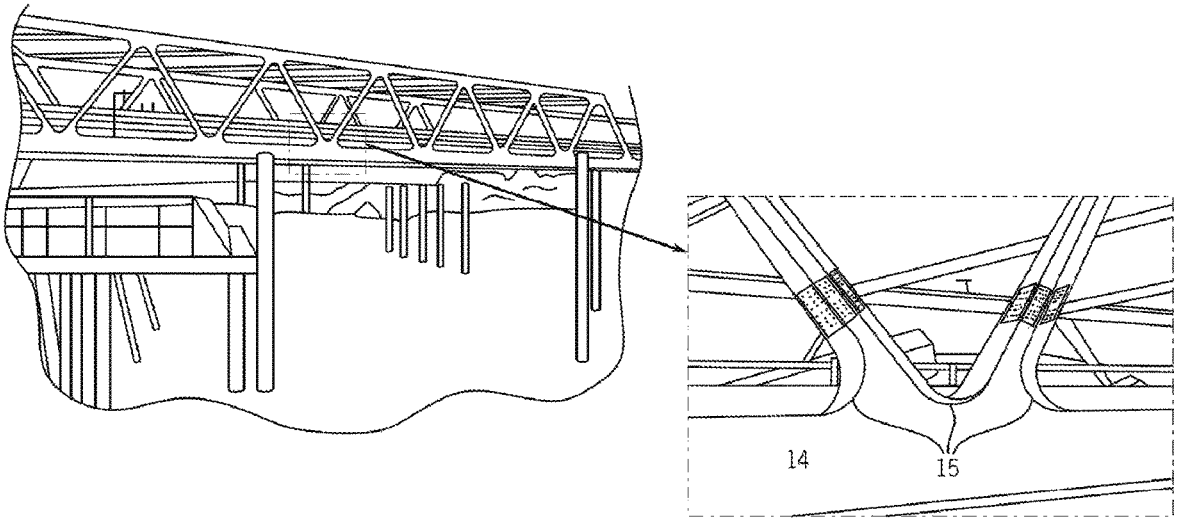
FIG. 2A (PRIOR ART)
FIG. 2A is a photograph of the Memorial Bridge connecting Portsmouth, N.H. and Kittery, Me.

The following description of example methods and apparatus is not intended to limit the scope of the description to the precise form or forms detailed herein. Instead the following description is intended to be illustrative so that others may follow its teachings.

The present disclosure is a new approach to modular construction which "modularizes" connections between structural members to form truss-type structures. The elements or structural members that connect between modular truss joints are termed diagonals or chords. By varying the length of the diagonal and chord, truss depth, joint spacing, and span can be readily changed. Constant depth and variable-depth truss-type structures can be formed. Applications include all forms of truss type structural systems, but with particular emphasis on bridge and building structural systems.

In comparison to existing strategies for modular construction (e.g., Bailey panelized bridge system shown and discussed above in regards to FIG. 1A-1D) which use rigid, rectangular truss panels 10 joined together by pin connectors 11, the approach in this disclosure "modularizes" the connection or joint. While this teachings of this disclosure retain all of the advantages of modular construction (e.g., prefabrication, mass-production, rapid erection, and re-usability), it overcomes the prime deficiency of existing technology, that a fixed panel size results in limiting span length. In addition, bolted splice connections can be used instead of pin connectors, allowing for a stronger, more durable and reliable connection between load carrying elements.

In truss-type structures, gusset plates typically join structural members. Limitations of gusset plates include the following: (1) inefficiency—as fasteners are typically connected in single shear a large number of fasteners are required, thereby increasing time and cost of fabrication as well as reducing the net section of the gusset plate, (2) poor durability—as debris can become trapped in the connections and connections are also subjected to deicing salts, (3) difficult to inspect which negatively impacts maintenance and service life, (4) difficult to maintain as connections are difficult to replace or repair, and (5) challenging fabrication.

These deficiencies have been overcome in the design of the "gussetless" Memorial Bridge connecting Portsmouth, N.H. and Kittery, Me. (FIG. 2) by using only splice-type connections 41 in double-shear. This is achieved by (1) moving the connections to the diagonals and along the length of the upper/lower chords (see elevation drawing in FIG. 2B) and (2) using wide flange sections in strong axis bending. Advantages include the following: (1) increased efficiency by using fasteners in double-shear, (2) connection locations can be chosen to facilitate inspection, maintenance, and repair, (3) readily available rolled wide flange sections can be used for the diagonals, and (4) the strong axis orientation of the members results in increased reliability and redundancy as chord members can carry load in bending if diagonals are lost.

Figure 2B:
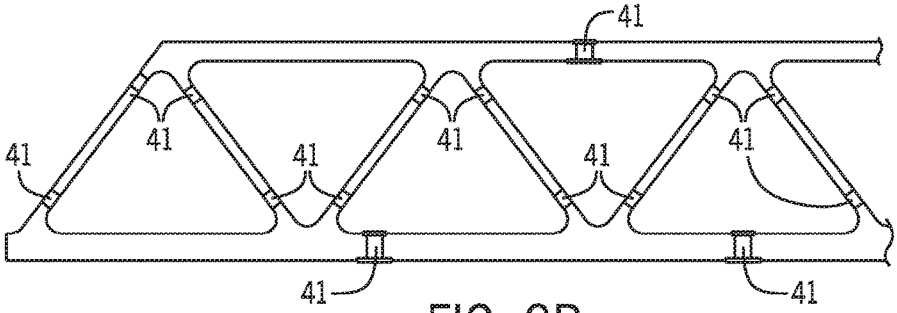
FIG. 2B (PRIOR ART)
FIG. 2B is an elevation view of the Memorial Bridge shown in FIG. 2A.
Figure 2C:
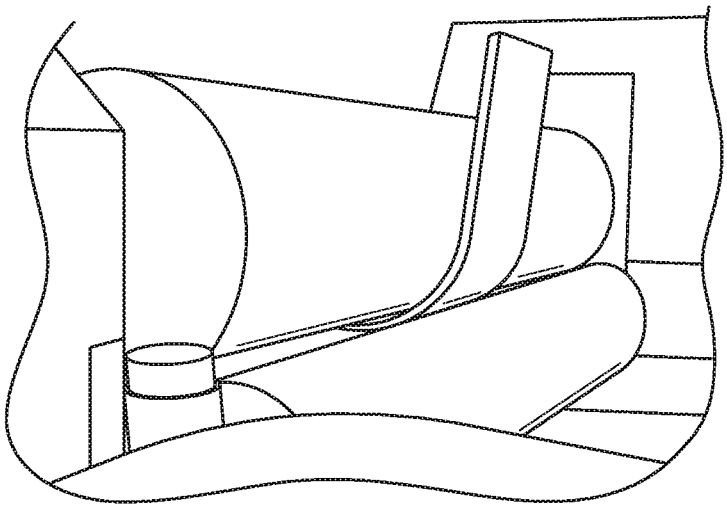
FIG. 2C PRIOR ART
FIG. 2C is a photograph of the fabrication of the Memorial Bridge shown in FIG. 2A.
Figure 2D:
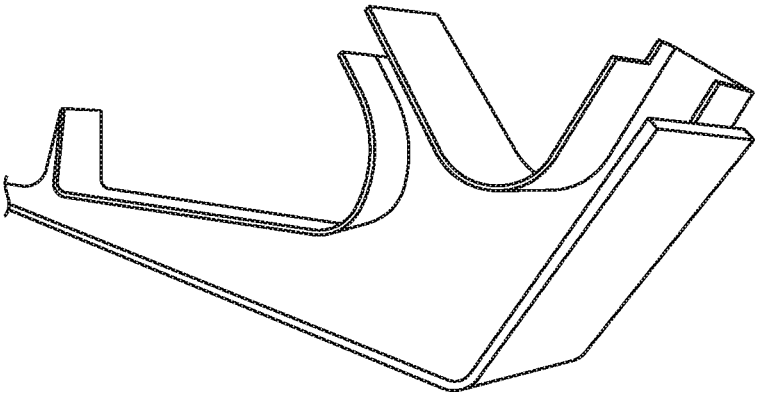
FIG. 2D PRIOR ART
FIG. 2D is another photograph of the fabrication of the Memorial Bridge shown in FIG. 2A.
Figure 3A:
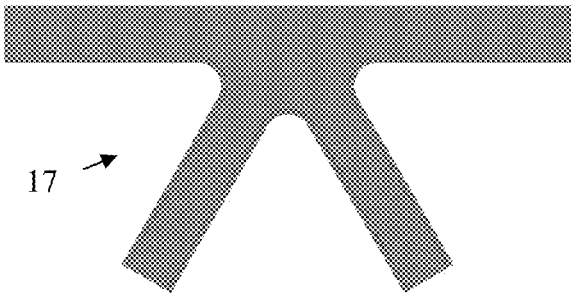
FIG. 3A is an elevation view of the example 4-noded modular truss joint.
Figure 3B:
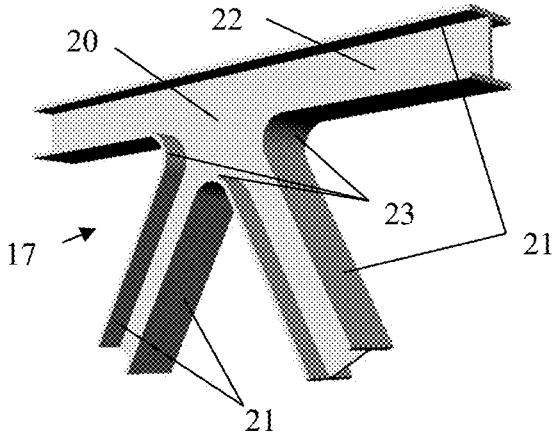
FIG. 3B is an isometric view of the example 4-noded modular truss joint.
Figure 3C:
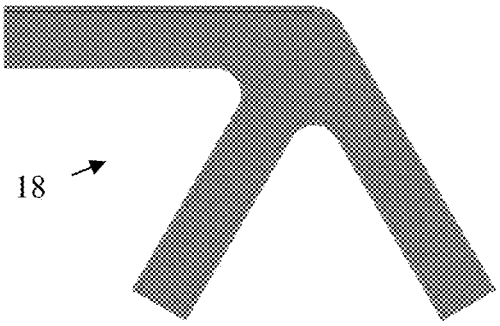
FIG. 3C is an elevation view of the example 3-noded modular truss joint.
Figure 3D:
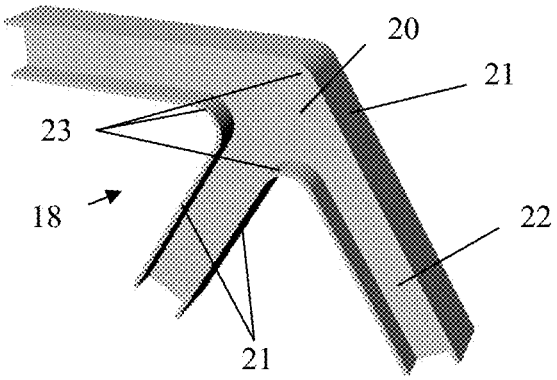
FIG. 3D is an isometric view of the example 3-noded modular truss joint.
Figure 3E:
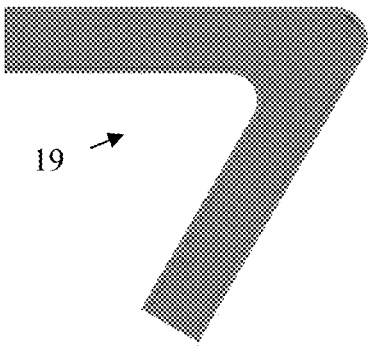
FIG. 3E is an elevation view of the example 2-noded modular truss joint.
Figure 3F:
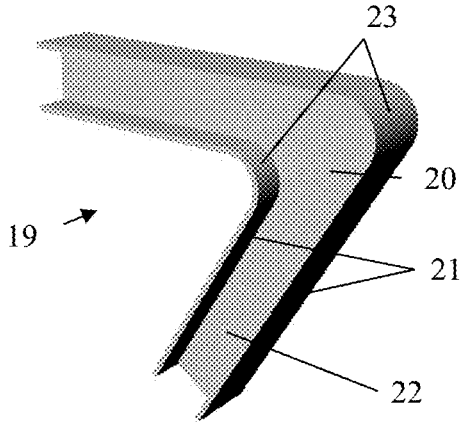
FIG. 3F is an isometric view of the example 2-noded modular truss joint.

Components of the Memorial Bridge were fabricated from steel plate, with the geometry and orientation of the component optimized to reduce waste in fabrication. The upper flanges 15 of the knuckle joint 14 in FIG. 2A are cold bent (FIG. 2C), welded to one another and to the webs, ultimately resulting in large completed segments of the bridge (FIG. 2D) which can be assembled using double-shear splice connections. These pieces can be erected rapidly in the field. This approach offered significant advantages in fabrication and erection time as well as cost.

While the "gussetless" Memorial Bridge addressed the deficiencies of typical truss-type systems, it is not a modular system. Neither the connections nor the components are modular. It is a one-of-a-kind structure which was designed for a specific span and load. It is not a modular "kit-of-parts" type system which can be readily adapted for a wide array of spans and loads. Chord and connection were integrated into a single component with the idea of minimizing connections and to maximize piece size (both for fabrication and trucking logistics). For Memorial Bridge, top chords and bottom chords were different depths from each other and different from the diagonals. Chord sections of the bridge were fabricated for truck transport (i.e., less than 65 ft long and 10 ft deep). All components were sufficiently large to require crane erection. In contrast, modular systems should be sufficiently small to fit in standard shipping containers (e.g., ISO containers) and to minimize erection equipment requirements, thereby facilitating transportation to a wide array of sites. Existing systems (e.g., Bailey, Acrow, and Mabey-Johnson) are all transportable by ISO shipping container. Accordingly, there is a demonstrated need in the art for an improved approach to modular construction as declared herein.

In comparison to existing strategies for truss-type construction which use gusset plates to join structural members, the approach in this disclosure eliminates the gusset plate and uses only bolted splice connections. While the teachings of this disclosure retain all of the advantages of the "gussetless" Memorial Bridge (e.g., ease of fabrication and erection, using bolted splice connections, moving connections to diagonals and along the length of the upper/lower chords, increased reliability and redundancy as chord members can carry load in bending if diagonals are lost), it overcomes the prime deficiency of the existing "gussetless" Memorial Bridge, that it is not modular. The modular truss joint is the module in this new approach for modular construction, which can be used for a wide variety of span lengths, joint spacing, structural depths, and structure types (e.g., simply supported or continuous trusses). Varying span lengths, joint spacings, and structure depths are achieved by changing the length of chords and diagonals. In this way a single joint type can be used for many truss-type structures. The chords and diagonals can be readily available sections that can be simply cut to the desired length and drilled for connection to the joint. The joint is designed to be easily transportable, for example in an ISO shipping container.

FIGS. 3A-3F shows an example 4-noded modular truss joint 17, an example 3-noded modular truss joint 18, and an example 2-noded modular truss joint 19 in elevation (left)

and isometric (right) views. Each of these example modular truss joints is comprised of a weldment/built up section of web 20 and continuous flanges 21 that includes connectors 22 for connection to other structural members. The continuous flanges 21 are formed integrally with and oriented transversely to the web 20. Each of the connectors 22 is a portion of the web 20 and the continuous flanges 21 oriented on a side of the joint. As shown in the various example joints in FIGS. 3A-3F, the continuous flanges 21 are located on various regions of the joint positioned circumferentially at the perimeter of the modular truss joint. These regions where the flanges 21 are located serve to form the transverse sides of each connector 22. Some flanges 21 are bent to a prescribed radius in the regions 23 to achieve angled connections between structural members. The webs 20 and flanges 21 are shown as weldment/built up section to build the singular modular truss joint, but in other examples, it is contemplated that the joint could be fabricated as a single piece such as using casting. As the chord connectors are members with a wide flange shape, they can be readily connected to wide flange bodies 200 of similar dimensions. In this disclosure, wide flange body refers to any member with a wide flange shape, which can include other modular truss joints (whose connectors 22 have a wide flange shape) and rolled or built-up wide flange beams, or other wide flange shaped structural members, which can include diagonals or chords.

Figure 4:
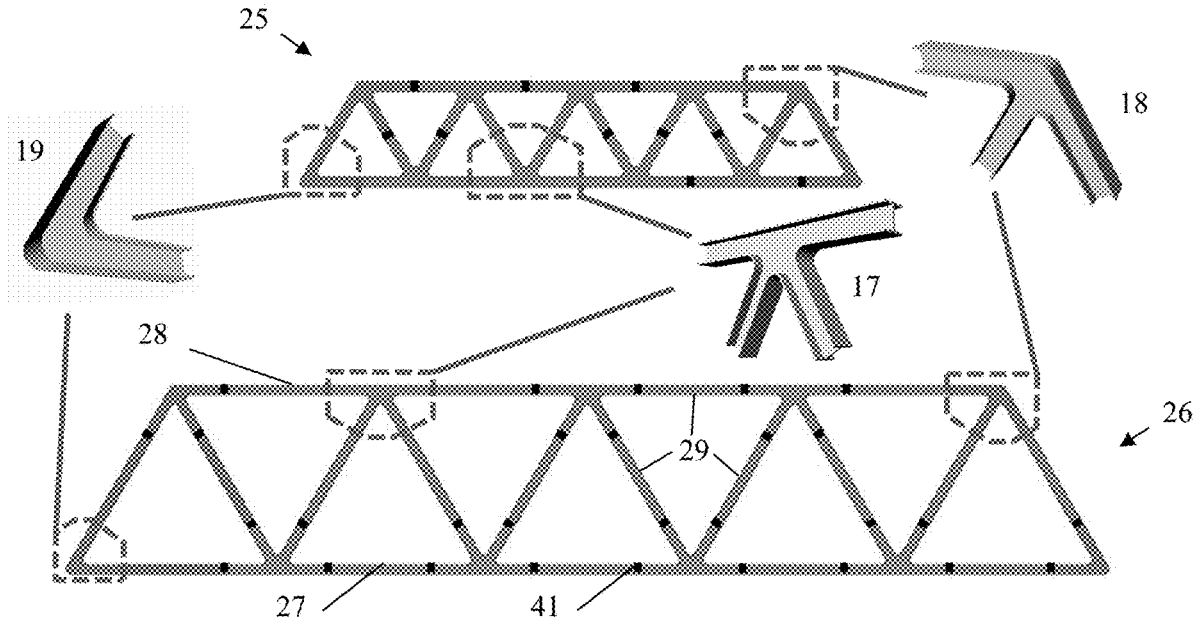
FIG. 4 shows example constant-depth trusses formed using 4-noded, 3-noded, and 2-noded modular truss joints, as well as diagonals and chords.

FIG. 4 shows example constant-depth bridges comprised of the 4-noded modular truss joint 17, the 3-noded modular truss joint 18, and the 2-noded modular truss joint 19. The first example bridge 25 uses modular truss joints joined directly to one another. The second example bridge 26 uses modular truss joints joined with wide flange members including in the example shown: wide flange lower chords 27, wide flange upper chords 28, and wide flange diagonals 29. Splice connections 41 between components are shown in black. The same modular truss joint can be used for many different spans, as the lower chords 27, upper chords 28, and diagonals 29 can have varying lengths to achieve varying structural depths, joint spacing, and span. This is a departure from panelized bridges where the entire truss panel (diagonals and chords) are prefabricated. Herein, the modular truss joint is prefabricated as separate from chords and diagonals to allow for more modularity. The depth, span, and joint spacing of the disclosed truss system are no longer fixed. The depth, span, and joint spacing in the disclosed system are defined by the length of the chords and diagonals, independent of the modular truss joint. This variation is an important distinction in terms of modularity and a significant departure from current panelized bridge technology.

Figure 5A:
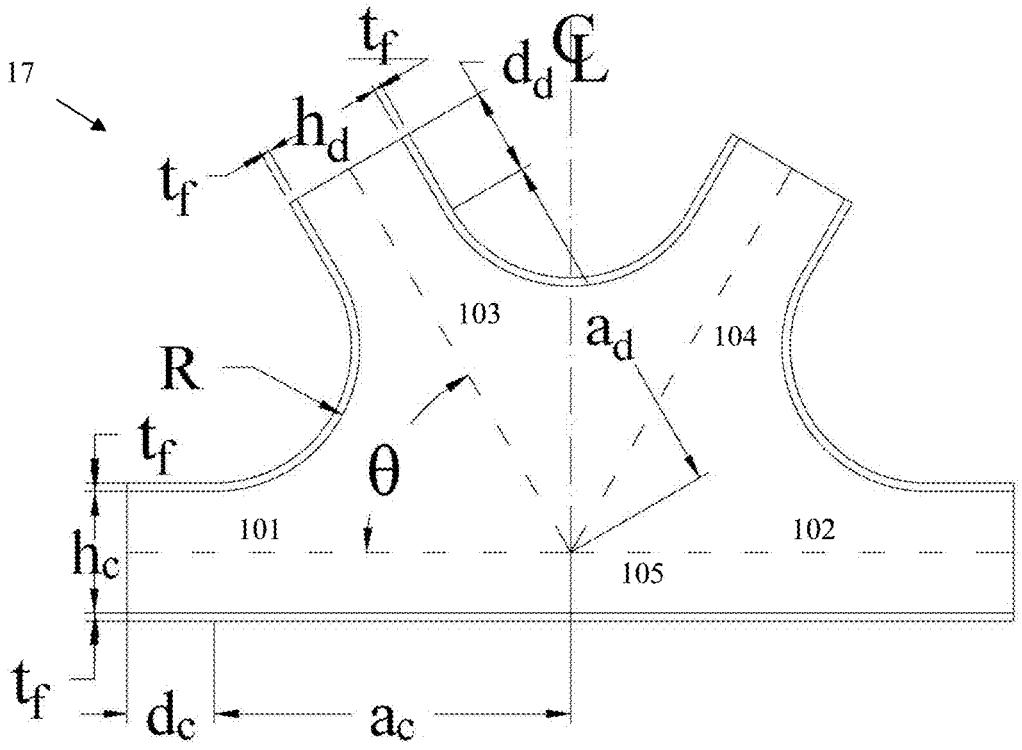
FIG. 5A is an elevation view of an example 4-noded modular truss joint.
Figure 5B:
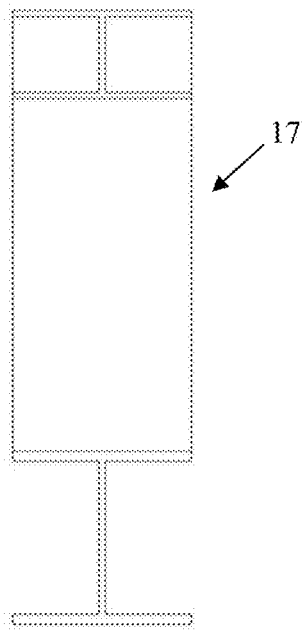
FIG. 5B is a side view of the example 4-noded modular truss joint shown in FIG. 5A.

FIG. 5A shows an elevation view of an symmetric example of 4-noded modular truss joint 17. FIG. 5B shows a side view of this example 4-node modular truss joint 17. As drawn in FIG. 5A, this example 4-noded modular truss joint 17 includes a first chord connector 101, a second chord connector 102, a first diagonal connector 103, and a second diagonal connector 104. The centerlines of the connectors (shown as dashed lines in FIG. 5A) meet concentrically at one location 105. In the case when the centerlines of the connected wide flange member, for example a diagonal, chord, or other joint, coincide with the centerlines of the connectors, then all members are concentric at the joint, which can be advantageous for load transfer. However, not every implementation of the modular truss joint connects the centerlines of the wide flange body, for example, to form a variable-depth structure by varying the relative angles of the wide flange bodies. FIG. 5A assumes a joint that is symmetric about the indicated centerline. This symmetric joint 17 in FIG. 5A is defined by (1) the inner radius of curvature R of the bent flanges (assumed to be the same for all three bent flanges), (2) the joint angle θ between the chord connectors 101,102 and the diagonal connectors 103,104, (3) the straight length ($d_c$) of the chord connectors 101,102, (4) the straight length $d_d$ of the diagonal connectors 103,104, (5) the thickness of the continuous flanges $t_f$ (assumed to be the same for all flanges), (6) the depth of the chord connector 101,102 webs $h_c$, and (7) the depth of the diagonal connector 103,104 webs $h_d$. If, in addition to the assumptions noted above, the chord connectors 101,102 and the diagonal connectors 103,104 are assumed to have the same depth h (i.e., $h=h_c=h_d$), then the joint lengths $a_c=a_d$ can be calculated as a single joint length a as follows:

$$a = \frac{\left(\frac{h}{2} + R\right)}{\tan\theta} \qquad \text{eq. (1)}$$

Many geometric assumptions, as noted above, are considered here. However, these assumptions do not need to hold. In some examples including that shown and discussed below in reference to FIG. 15A, the depth of each connector, the length of each connector, and the angle of each connector may not be the same. As previously mentioned, some joints may be adapted to form other truss-type structures without equal length or equal depth or equal angles of connectors.

An advantage of using the web depth h (as opposed to the total depth of the chord/diagonal connector sections which includes the thickness of the flanges) to define the modular truss joint is that the web depth is constant for an entire family of wide flange rolled sections as a result of the fabrication process (e.g., h is approximately 12.58 in. for all W14 rolled sections). This would enable a wide variety of chord and diagonal sizes to be joined with the same modular truss joint. This allows the modular truss joint to be truly modular. If a modular truss joint is designed for W14 geometry and a maximum force associated with a W14×257, it can by definition accept any smaller W14 section (there are 24 smaller W14 sections that could be used for the same joint). W14 or W12 sections are especially useful for this application as they are widely used for columns in buildings (to carry axial load) and there are many section types readily available.

The example modular truss joint in FIGS. 5A and 5B has a joint angle θ=60 degrees between the lower chord connectors 101, 102 and the diagonal connectors 103, 104. If this joint were to join W14 diagonals and chords, then the height h of the webs would be h=12.58 in. as this is the approximate web height of W14 rolled sections. Selecting a radius of curvature R that exceeds 5 times $t_f$ is advantageous as that is the minimum value allowed for cold bending in current bridge design code. It is recommended for this example joint that R exceed 10 or even 15 times $t_f$. If R is selected to be 15 in., then the value for a=36.8754 in. It is also recommended that the straight length of the connectors, $d_c$ and $d_d$, be at least 9 in. to facilitate a bolted splice connection 41 to chords, diagonals, or other modular truss joints.

Figure 6A:
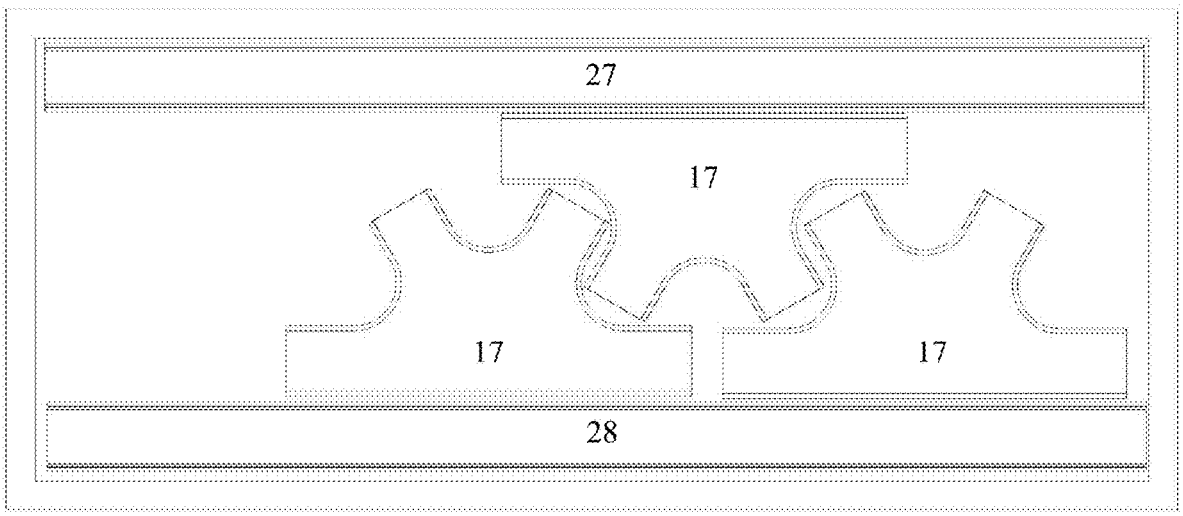
FIG. 6A is an elevation view of 4-noded modular truss joints nested to fit in an ISO shipping container.
Figure 6B:
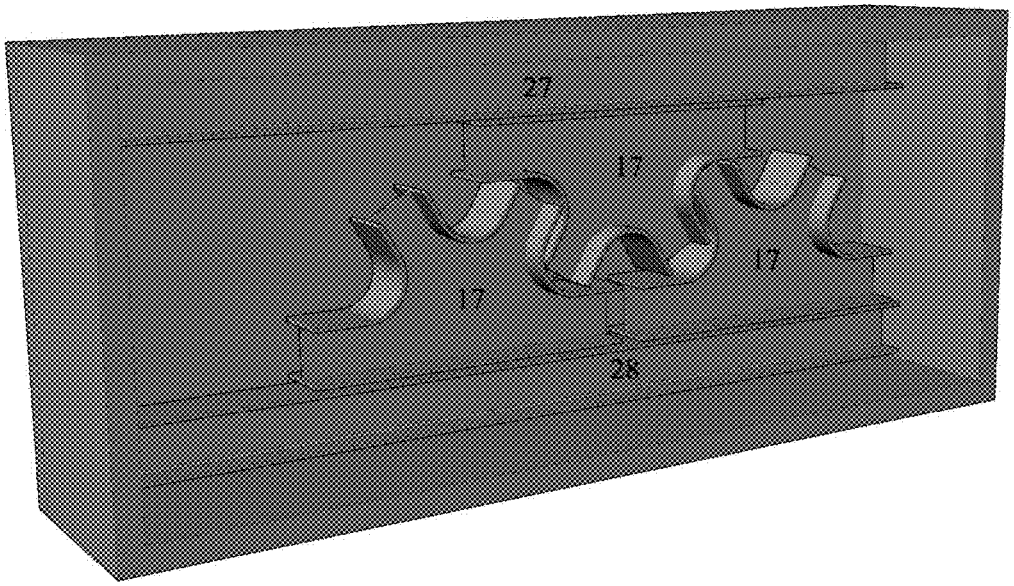
FIG. 6B is an isometric view of 4-noded modular truss joints nested to fit in an ISO shipping container.

The modular truss joint can be sufficiently small such that it can be transported in standard shipping containers (e.g., ISO containers). The joints can be nested as shown in FIG. 6A-B to maximize the number of joints (shown for example for the 4-noded modular truss joint 17) and wide flanged members like chords 27, 28 that can be transported in a single container. This makes the modular truss joint system competitive with existing modular bridges (e.g., Bailey, Mabey-Johnson, and Acrow systems).

Figure 7:
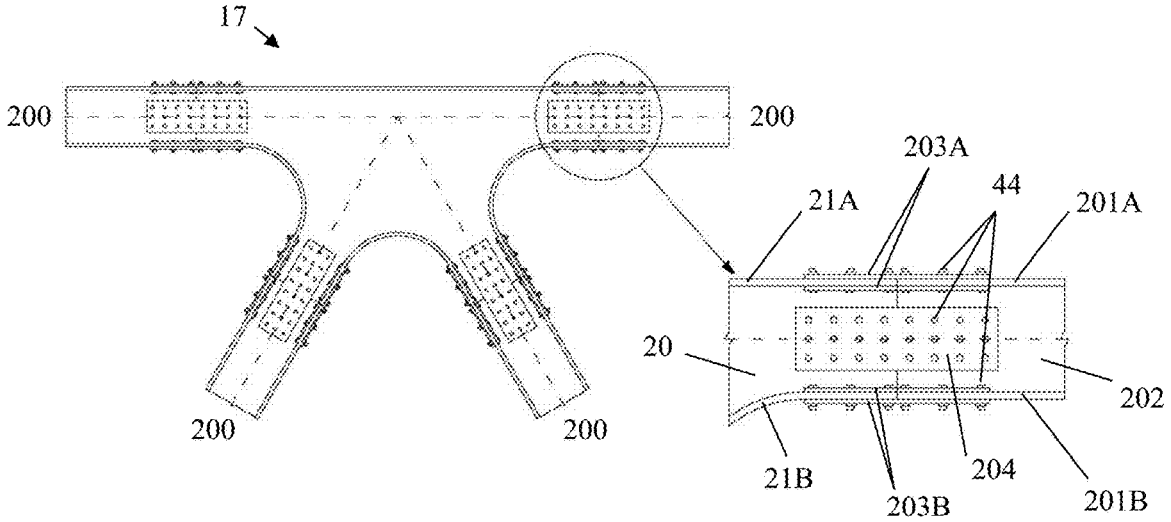
FIG. 7 is an elevation view of an example connection between an example 4-noded modular truss joint and wide flange bodies using bolted splice connections.

FIG. 7 is an example demonstration of the connection of the example modular truss joint 17 to wide flange bodies 200 at each node. Bolted splice connections 41 in double shear join (1) the top flange 21A of the joint to the top flange 201A of a wide flange body by top flange splice plates 203A and bolts 44, (2) the bottom flange 21B of the joint to the bottom flange 201B of a wide flange body by bottom flange splice plates 203B and bolts 44, and (3) the web 20 of the joint and to the web 202 of the wide flange body by web splice plates 204 and bolts 44. This connection between the modular truss joint 17 and a wide flange body 200 is through a bolted splice type connection 41 whereby webs 20, 202 and flanges 21, 201 are connected independently thereby achieving a moment-resisting connection. As both faces of the webs 20, 202 and flanges 21, 201 are connected, bolts 44 are used in double shear reducing the size and number of bolts required in the connection.

In this way, each example modular truss joint is specifically configured to resist flexural forces and to promote double shear connections to wide flange bodies 200. As conventional truss joints are not typically designed to carry flexure, this is a significant enhancement to conventional truss design. In conventional bridge design, truss chords and diagonals are typically oriented as an H instead of an I, and only the flanges are connected through gusset plates (the webs are not connected). In this conventional configuration, chords and diagonals are typically connected to carry only axial loads and not local shear and flexure. The modular truss joint's ability to carry flexure allows for enhanced performance of the truss system and the ability to tolerate truss member damage or failure (as flanges are continuous). These connections can be rapidly assembled in the field, thereby accelerating construction times. This configuration also allows connection of only webs or flanges to achieve different behavior.

As shown and discussed above in regard to FIG. 4, example modular truss joints 17-19 can be used to form example constant-depth bridges 25, 26. The following includes a brief study that explores example constant-depth bridges in more detail, focusing on simply supported bridges. The aim of this study is to select a "family" of constant-depth simply supported bridges with different span lengths for which the force in the chords is the approximately the same. If this is the case, then the same modular truss joint could be used for the entire family of spans, thereby creating a modular system. Varying lengths of the diagonals and chords are used to achieve the varied depths and spans in this family.

For a simply supported truss 50 [i.e., pin restrained on one end (translation restrained in all directions, free rotation permitted), roller supported on the other end (free translation along the longitudinal direction, translation restrained in all other directions, free rotation permitted)] with a depth $H_i$ and a span length $S_i$ (see for example FIG. 8), the force in the upper and lower chords $F_i$ at midspan under a uniformly distributed load (q) can be approximated as:

$$F_i = \frac{qS_i^2}{8H_i} \qquad \text{eq. (2)}$$

This relationship is developed based on the moment at midspan for a simply supported beam under a uniformly distributed load. This moment is assumed to be carried by equal and opposite axial forces in the upper and lower chords (neglecting any contribution from the diagonals).

If a targeted span $S_1$ and depth $H_1$ is selected for one truss in a "family" of trusses, then to achieve different span lengths $S_i$ while maintaining approximately the same force $F_i$ in the chords, the depth $H_i$ can be scaled as follows:

$$H_i = \left(\frac{S_i}{S_1}\right)^2 H_1 \qquad \text{eq. (3)}$$

The depth of each bridge relates to the horizontal length between joints $x_i$ and the joint angle θ (between chords and diagonals as shown in FIG. 8, identified in FIG. 5A for an example 4-noded modular truss joint) by:

$$H_i = \frac{x_i}{2}\tan\theta \qquad \text{eq. (4)}$$

To use the same modular truss joint for the family of spans, the joint angle θ should remain the same.

The horizontal length between joints $x_i$ can be expressed using the number of truss joints $n_i$ in the lower chord and the span length $S_i$ by:

$$x_i = \frac{S_i}{n_i - 1} \qquad \text{eq. (5)}$$

The number of truss joints $n_i$ must be an integer.

If $x_1$ is the horizontal length between joints and $n_1$ is the number of truss joints for the targeted system, then the following relationship can be developed by combining Equations (3), (4), and (5):

$$\frac{n_1 - 1}{n_i - 1} = \frac{S_i}{S_1} \qquad \text{eq. (6)}$$

An example family of constant-depth simply supported trusses has been developed with spans of 200 ft, 300 ft, and 400 ft. The 300 ft span is targeted (identified with an index of 1; $S_1$=300 ft) as this is toward the upper limit where existing panelized systems can perform. The 400 ft span presents the opportunity to reach greater spans than those currently achievable by existing panelized systems and the 200 ft span demonstrates the opportunity for the modular truss joint to compete in the same space as existing panelized systems. By Equation (6), it is recognized that to obtain an integer number of truss joints for the 200 ft, 300 ft, and 400 ft spans, the number ($n_1$−1) for the 300 ft span must be a multiple of 4. Therefore, trusses with 5, 9 and 13 number of truss joints were considered for the 300 ft span. FIG. 9 shows the resulting three families, including the number of truss joints and horizontal length between the joints x for each truss. Family 3 was selected for further consideration to keep the horizontal length between joints x for the 400 ft span reasonable.

Reasonable span to depth ratios for simply supported trusses range from 10 to 15. To achieve a span to depth ratio in this range and a joint angle that can be easily fabricated (i.e., a round number) for the targeted 300 ft span, a joint angle of θ=60 degrees is chosen. This joint angle is maintained for all of the trusses in the family. Once this angle is selected, then the depth is determined by Equation 4 (with the horizontal length between joints x already determined via Equation 5). FIG. 10 shows the final selections of the depth, horizontal length between joints, and span to depth ratio of the family of trusses. FIGS. 11A-C shows elevation views of the resulting bridges.

Preliminary design of the 200, 300 and 400 ft constant-depth simply supported bridges was performed. More specifically, three-dimensional linear (eigenvalue) buckling analyses were performed for each bridge under dead load, superimposed dead load of the deck (assumed to be 1.125 kips/ft for a lightweight deck), uniformly distributed live load (i.e., 0.64 kips/ft to represent one lane of vehicular traffic per bridge design code; applied over half of the span and over the entire span), and wind loads (assumed to be 50 psf). These example bridges are designed to carry only a single lane of vehicular traffic, but could be designed to include additional lanes of traffic. To achieve a 12 ft design lane width, the bridges are 15 ft wide in the transverse direction. The bridges are simply supported, with roller boundary conditions on side (i.e., free rotation in all directions, free translation along the longitudinal axis of the bridge, translation restrained in all other directions) and pinned boundary conditions on the other side (i.e., free rotation in all directions, translation restrained in all directions). Wide flange sections for the diagonals and chords, as well as lateral bracing, were selected to achieve buckling factors greater than or equal to 2.5 for the 200 ft, 300 ft, and 400 ft spans. W14 sections were targeted for all three spans so that the same modular truss joint (with a web height h based on W14 sections) could be used for the entire family of bridges. Note that this preliminary design did not explicitly model the modular truss joint. The model includes only frame elements concentrically joined at nodes (where the modular truss joint would be) for simplicity. All frame elements are moment connected. Further detailed finite element analysis of the modular truss joint would be performed in later design stages.

Figure 12A:
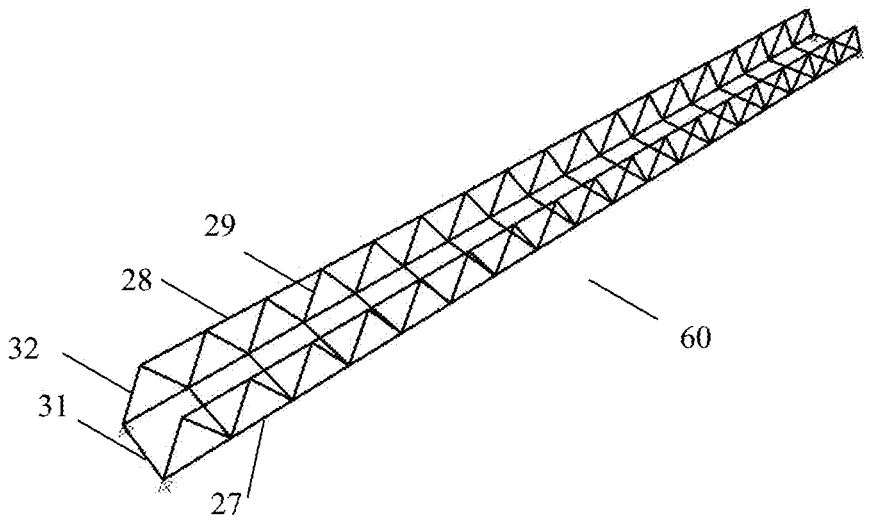
FIG. 12A is an isometric view of the example 200 ft constant-depth simply supported truss bridge.
Figure 12B:
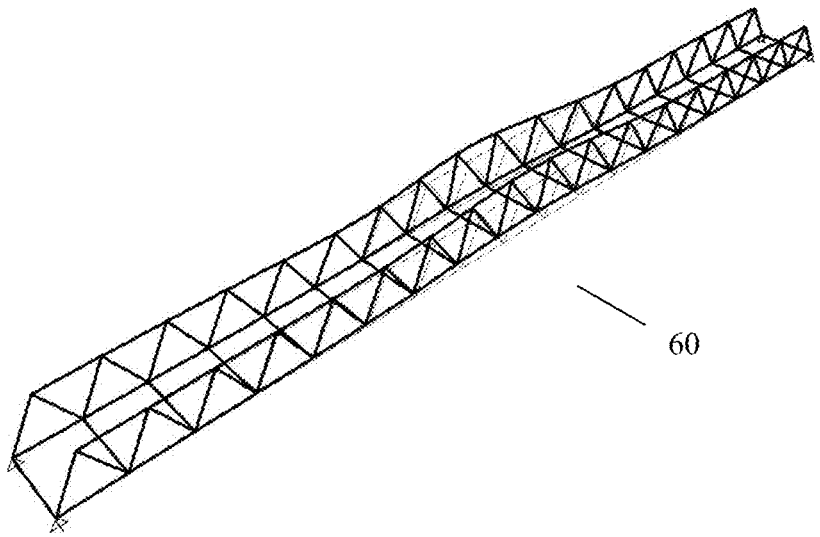
FIG. 12B is an isometric view of the buckled shape of the example 200 ft constant-depth simply supported truss bridge.
Figures 12C, 13A:
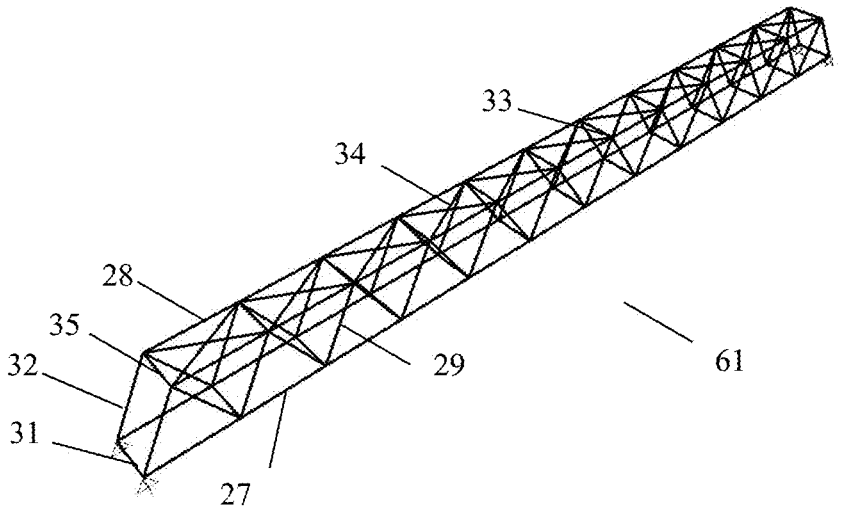
FIG. 12C is a table showing the sections sizes, buckling factor, and self-weight of the example 200 ft constant-depth simply supported truss bridge in FIG. 12A.
FIG. 13A is an isometric view of the example 300 ft constant-depth simply supported truss bridge.

FIG. 12A shows an isometric view of the 200 ft bridge 60. Note that there is no lateral bracing on the top chord as it would interfere with traffic (due to the height of the bridge). FIG. 12B shows the buckled shape corresponding to the smallest buckling factor. FIG. 12C shows the section sizes selected for the upper chord 28, lower chord 27, diagonals 29, and the transverse floor beams 31. The diagonals in the portal region 32 have the same section size as the upper chord 28.

Figures 13B, 13C:
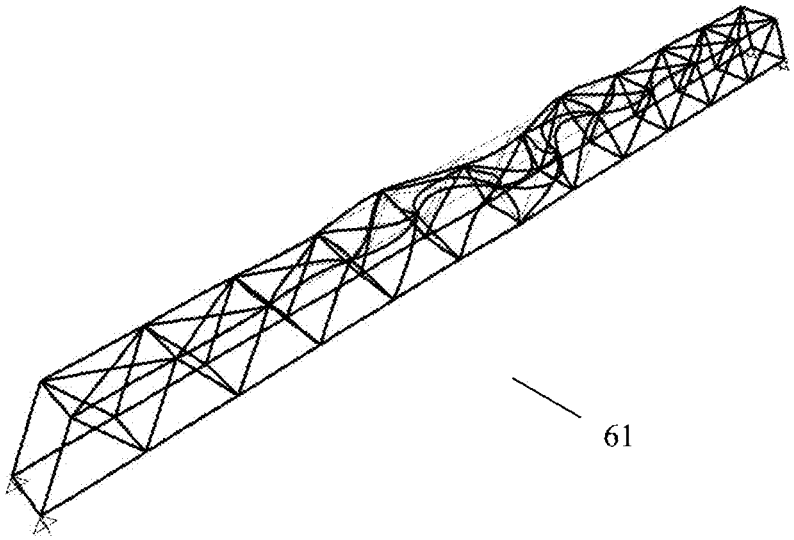
FIG. 13B is an isometric view of the buckled shape of the example 300 ft constant-depth simply supported truss bridge.
FIG. 13C is a table showing the sections sizes, buckling factor, and self-weight of the example 300 ft constant-depth simply supported truss bridge in FIG. 13A.

FIG. 13A shows an isometric view of the 300 ft bridge 61. FIG. 13B shows the buckled shape corresponding to the smallest buckling factor. FIG. 13C shows the section sizes selected for the upper chord 28, lower chord 27, diagonals 29, the transverse floor beams 31, the transverse lateral bracing 33, and cables providing x-shaped lateral bracing 34. The diagonals in the portal region 32 have the same section size as the upper chord. The transverse lateral bracing in the portal region 35 also have the same section size as the upper chord 28.

Figure 14A:
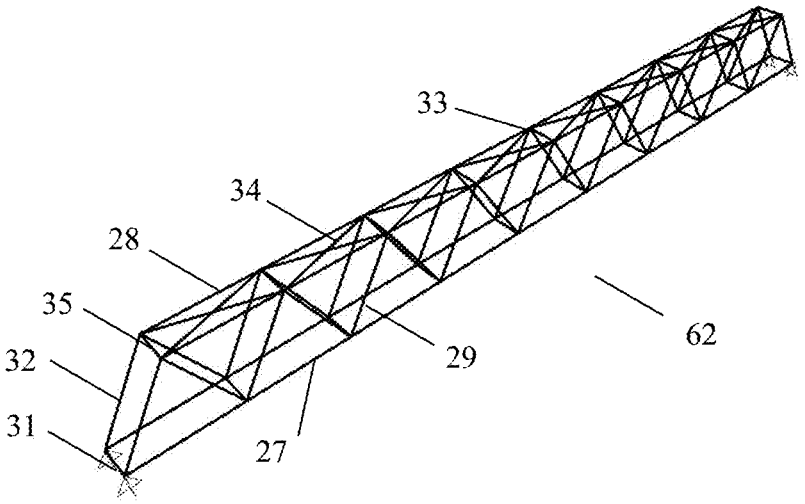
FIG. 14A is an isometric view of the example 400 ft constant-depth simply supported truss bridge.
Figure 14B:
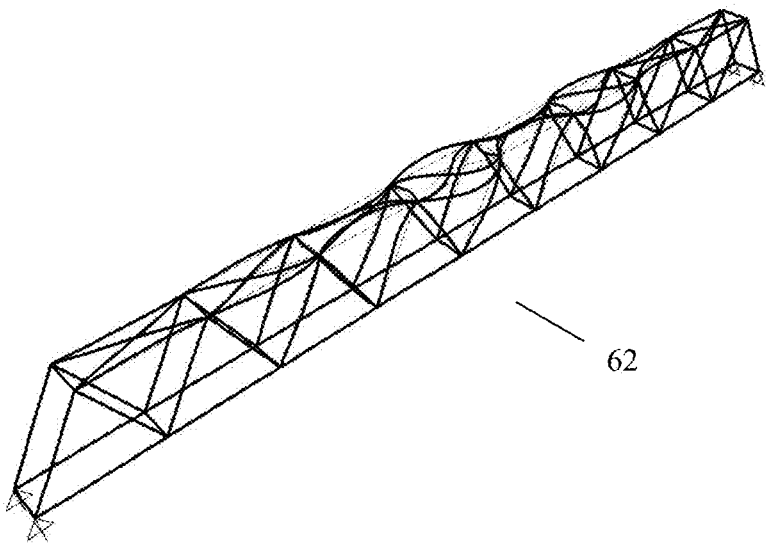
FIG. 14B is an isometric view of the buckled shape of the example 400 ft constant-depth simply supported truss bridge.
Figures 14C, 15A:
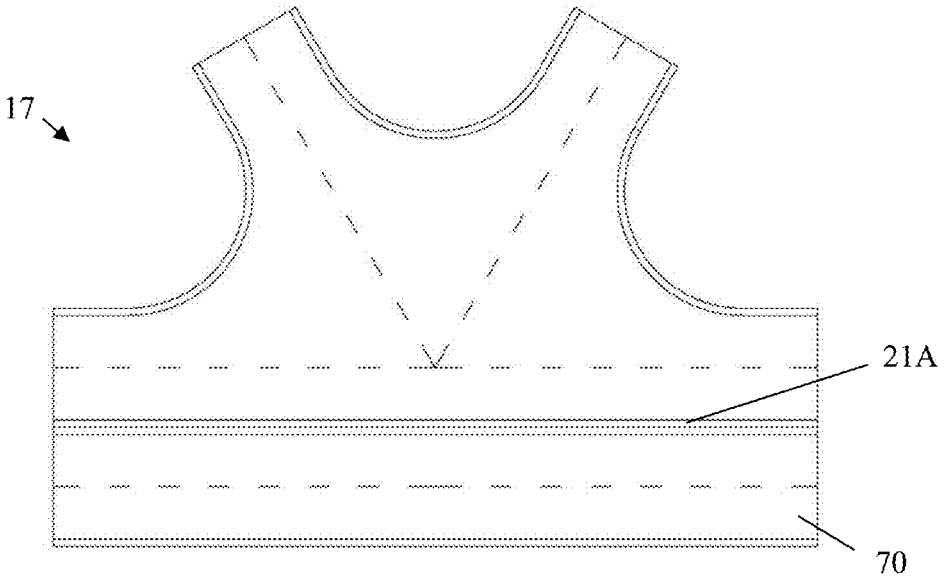
FIG. 14C is a table showing the sections sizes, buckling factor, and self-weight of the example 400 ft constant-depth simply supported truss bridge in FIG. 14A.
FIG. 15A is an elevation drawing of an example 4-noded modular truss joint with an additional beam attached to the bottom flange of the joint.

FIG. 14A shows an isometric view of the 400 ft bridge 62. FIG. 14B shows the buckled shape corresponding to the smallest buckling factor. FIG. 14C shows the section sizes selected for the upper chord 28, lower chord 27, diagonals 29, the transverse floor beams 31, the transverse lateral bracing 33, and cables providing x-shaped lateral bracing 34. The diagonals in the portal region 32 have the same section size as the upper chord. The transverse lateral bracing in the portal region 35 has the same section size as the transverse lateral bracing 33.

Figure 15B:
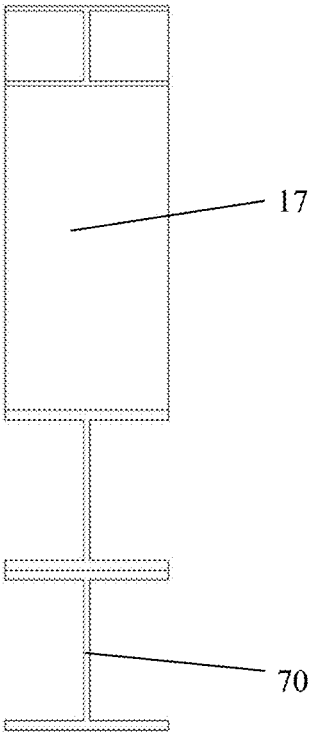
FIG. 15B is a side view of the example modular truss joint with an additional beam shown in FIG. 15A.

An example 4-noded modular truss joint 17 is shown in FIG. 15A-B (elevation and side view respectively), in which an additional beam 70 is attached to the flange 21A in the example by welding of the example modular truss joint 17. It is contemplated that the additional beam 70 could also be attached by bolts or any other suitable type of connection. This additional beam adds cross-sectional area and stiffness to the joint. With this addition, the modular truss joint 17 could carry more load. Deeper or shallower sections of the additional beam are possible. This additional beam is shown as a wide flange section, but other cross-sections could also be used such as WT or HSS sections.

Figure 16A:
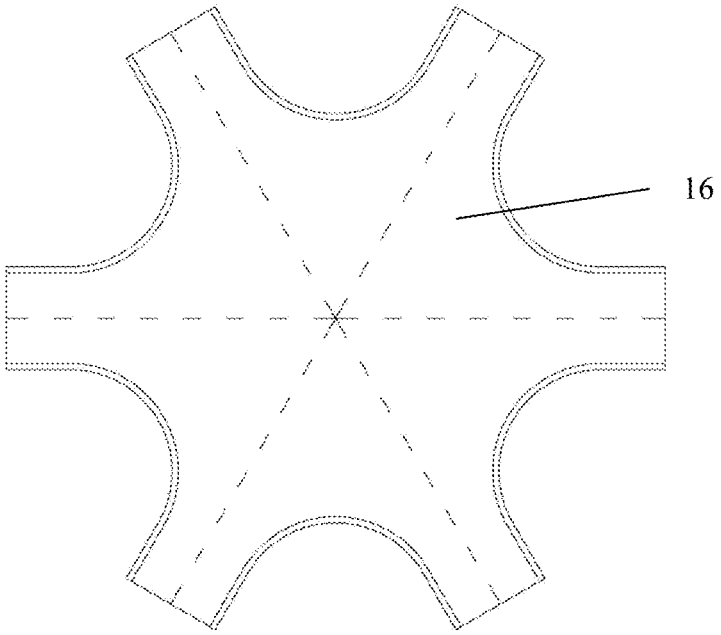
FIG. 16A is an elevation view of an example 6-noded modular truss joint.
Figure 16B:
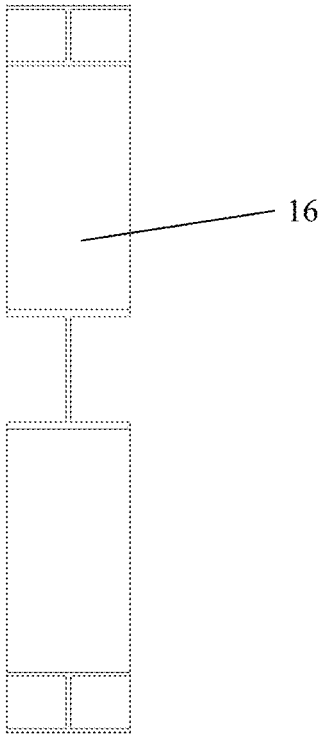
FIG. 16B is a side view of the example 6-noded modular truss joint shown in FIG. 16A.
Figure 16C:
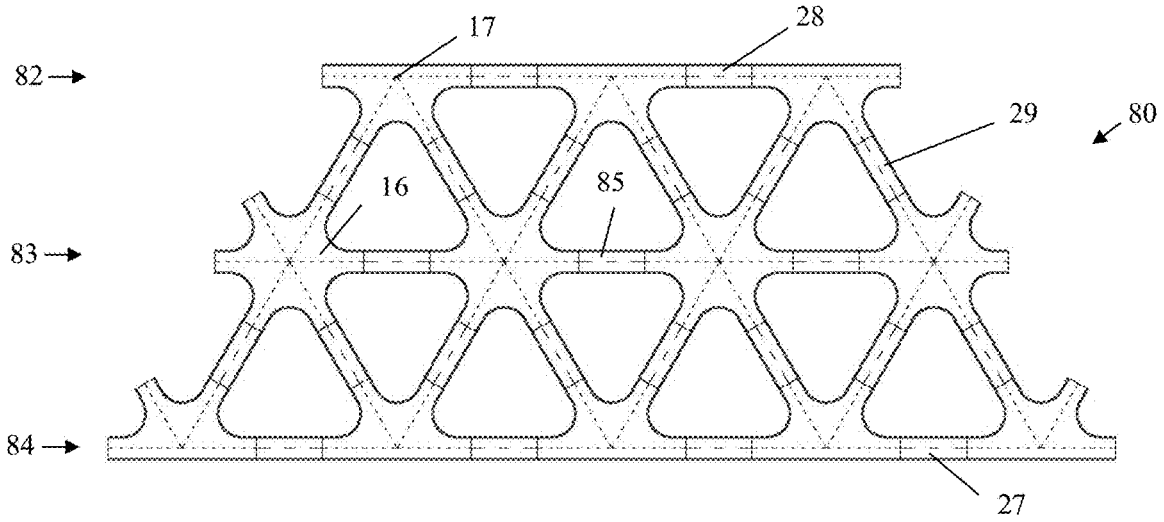
FIG. 16C is an elevation view of an example joint configuration using the 6-noded modular truss joint of FIG. 16A-B.

An example 6-noded modular truss joint 16 is shown on FIG. 16A-B (elevation and side view respectively). It can connect wide flange bodies 200, such as other modular truss joints and diagonals and chords, to form deeper and longer structures 80 as shown in FIG. 16C. The joints may be arranged in rows, including upper row 82 and lower row 84. Some arrangements also include an intermediate row 83 or multiple intermediate rows between the upper and lower rows 82, 84 including medial joints 6-noded modular truss joint 16 and medial members 85. In the example shown, the rows are in a linear arrangement, but it is contemplated that rows of joints may be curved, stepped or otherwise varied in shape to form a many shapes of variable-depth structures.

Figure 16D:
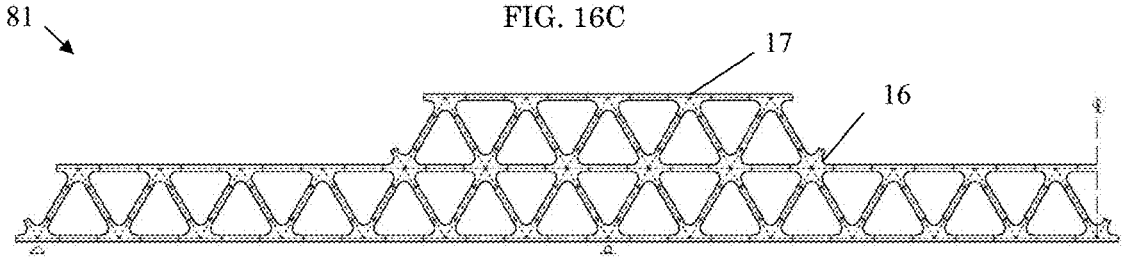
FIG. 16D is an elevation view of an example three-span continuous truss, based on the 6-node modular truss joint of FIG. 16A-B. Only half of the truss is shown, with symmetry assumed. Restraints are not symmetric and would include one pin and three rollers as shown in FIG. 21.

The example 6-noded modular truss joint 16 can be used to form structures, like bridge 81 with varying numbers of rows as shown in FIG. 16D. FIG. 16D represents an example three-span continuous truss bridge 81. The depth is increased at an inner pier where shear and moment demand is high. This demonstrated ability to use rows of modular truss joints, such as 6-noded modular truss joint 16 or others, together (also with diagonals 29 and chords 27, 28) enables greater material efficiency as material can be placed where it is needed based on demand.

Figure 17A:
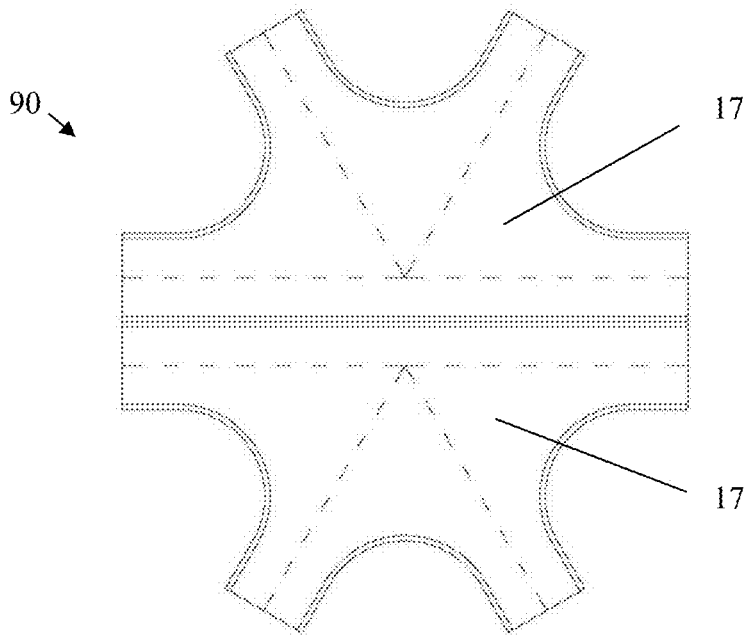
FIG. 17A is an elevation view of an example of two 4-noded modular truss joints connected at the flanges to form a double-stacked configuration.
Figure 17B:
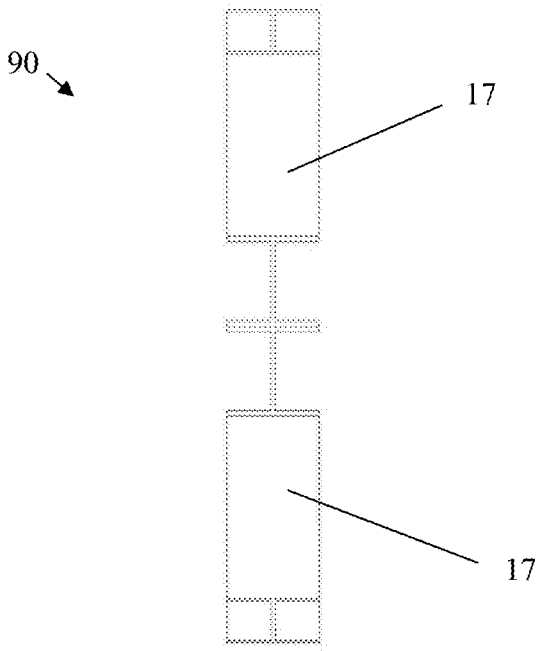
FIG. 17B is a side view of the example double-stacked modular truss joint shown in FIG. 17A.
Figure 17C:
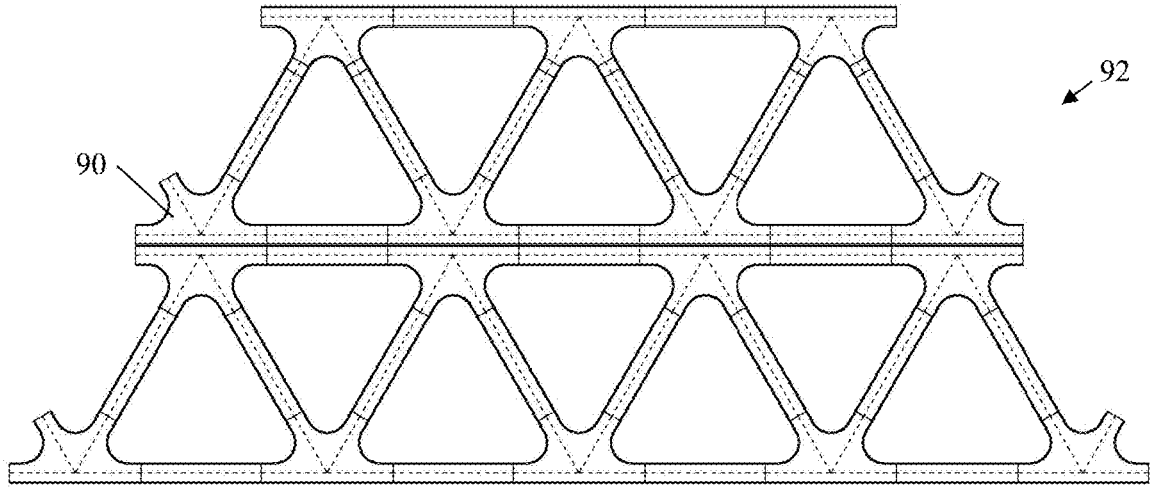
FIG. 17C is an elevation view of an example joint configuration using the double-stacked modular truss joint of FIG. 17A-B.
Figure 17D:
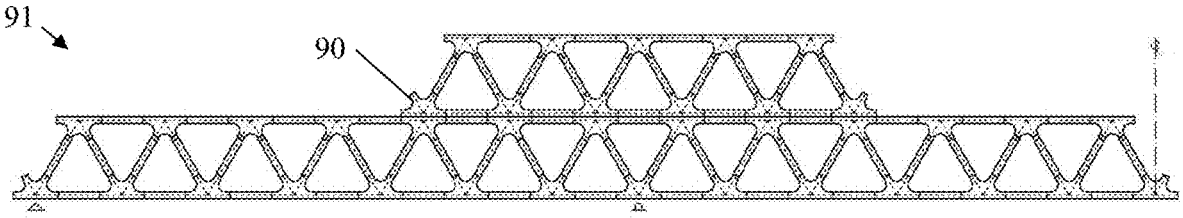
FIG. 17D is an elevation view of an example of three-span continuous truss, based on the double-stacked modular truss joint of FIG. 17A-B. Only half of the truss is shown, with symmetry assumed. Restraints are not symmetric and would include one pin and three rollers as shown in FIG. 21.

A double-stacked modular truss joint 90 can be achieved by connecting two 4-noded modular truss joints 17 at the flanges (via bolts, welds, or other connectors) as shown in FIG. 17A-B (elevation and side view respectively). This example double-stacked modular truss joint 90 can be combined with other modular truss joints and diagonals and chords to form deeper and longer trusses with multiple rows of joints. FIG. 17C shows an example joint configuration 92 using the double-stacked joint 90. The number of rows can be varied along the length of the structure as shown in FIG. 17D. FIG. 17D represents an example three-span continuous truss bridge 91. The depth is increased at an inner pier where shear and moment demand is high. This demonstrated ability to use rows of modular truss joints together (also with diagonals and chords) enables greater material efficiency as material can be placed where it is needed based on demand.

Figure 18A:
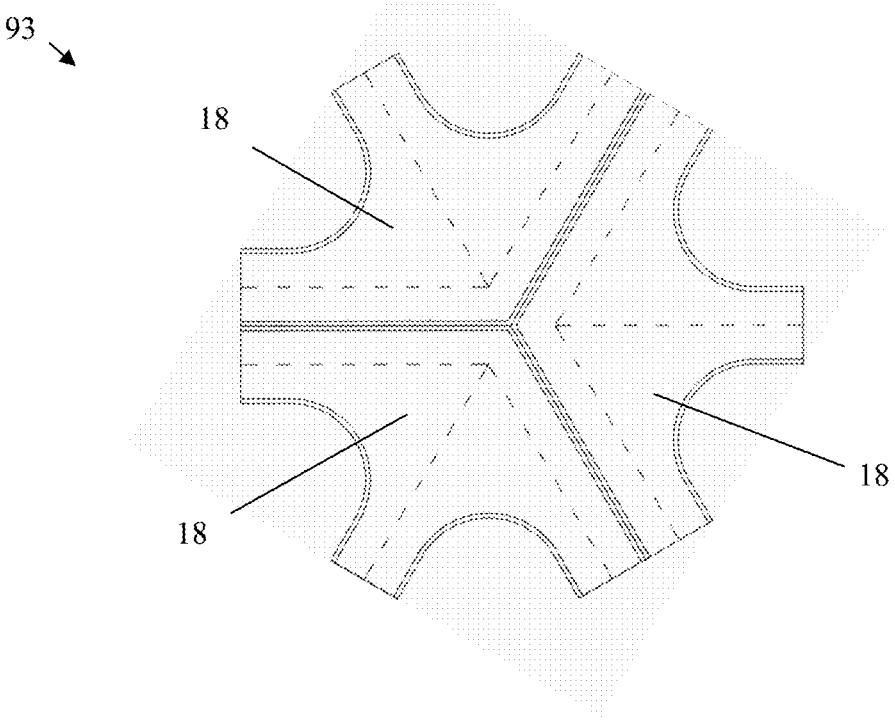
FIG. 18A is an elevation view of an example of 3-noded modular truss joints connected at the flanges to other 3-noded modular truss joints.
Figure 18B:
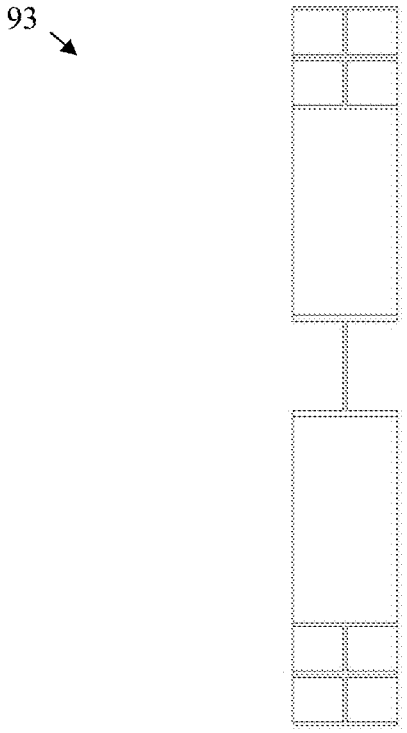
FIG. 18B is a side view (rightward) of the example configuration in FIG. 18A.
Figure 18C:
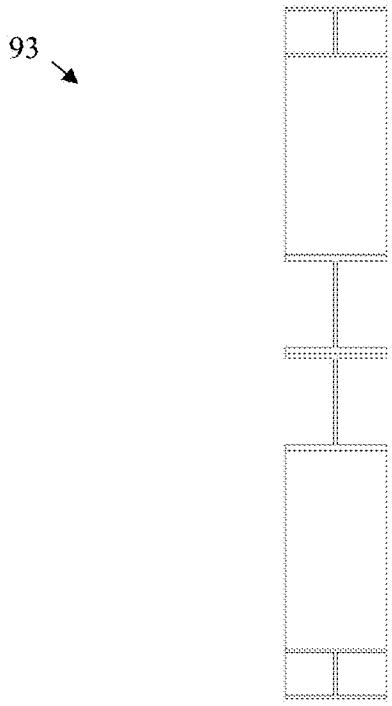
FIG. 18C is a side view (leftward) of the example configuration in FIG. 18A.
Figure 18D:
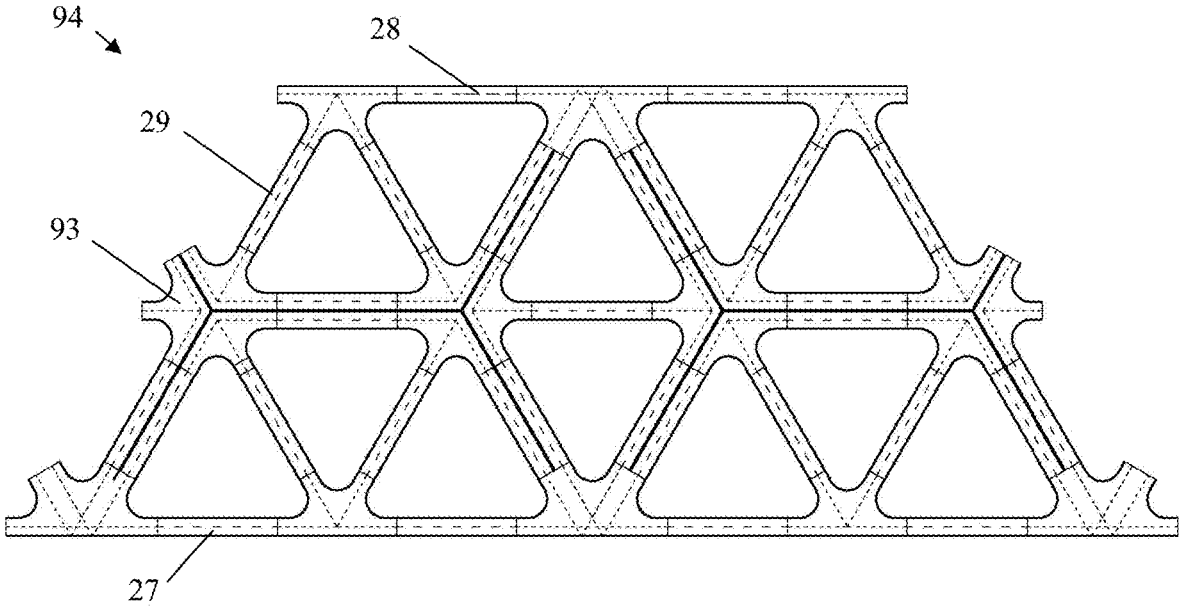
FIG. 18D is an elevation view of an example joint configuration using the example configuration of FIG. 18A-C.

3-noded modular truss joints 18 can be joined together to form the example modular truss joint 93 shown in FIG. 18A-C (elevation and side views respectively). This modular truss joint 93 can be used with diagonals 29 and chords 27, 28 and other joints to form a deeper structure 94. An example configuration of structure 94 is demonstrated in FIG. 18D. This configuration of structure 94 shows that diagonals 29 could be doubled in some locations and not others. The locations for doubling the diagonals could be selected based on demand.

Figure 19A:
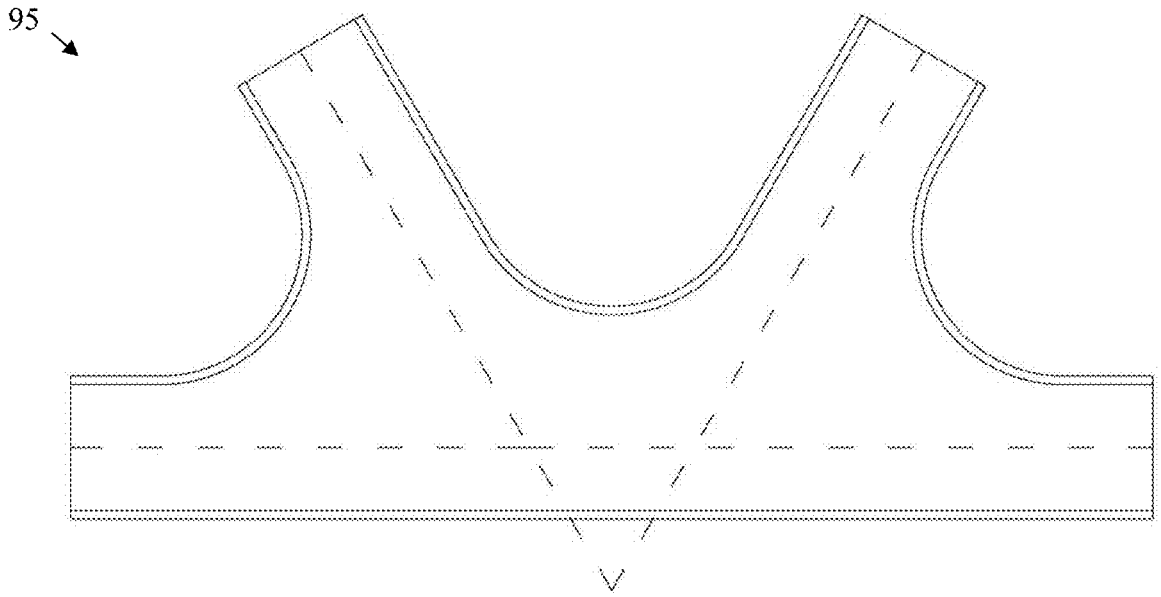
FIG. 19A is an elevation view of an example 4-noded modular truss joint with eccentric members.
Figure 19B:
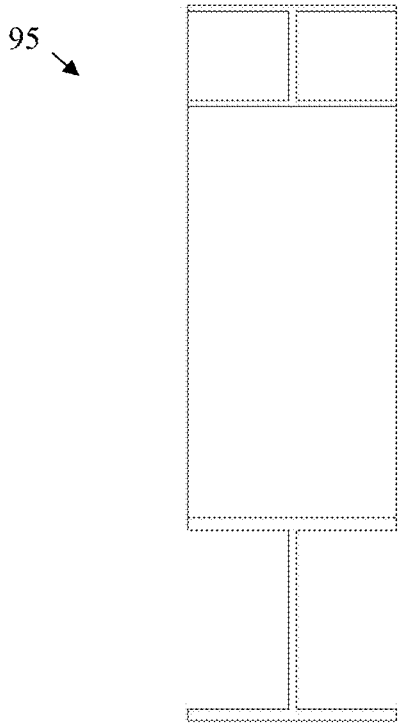
FIG. 19B is a side view of the example 4-noded modular truss joint shown in FIG. 19A.
Figure 19C:
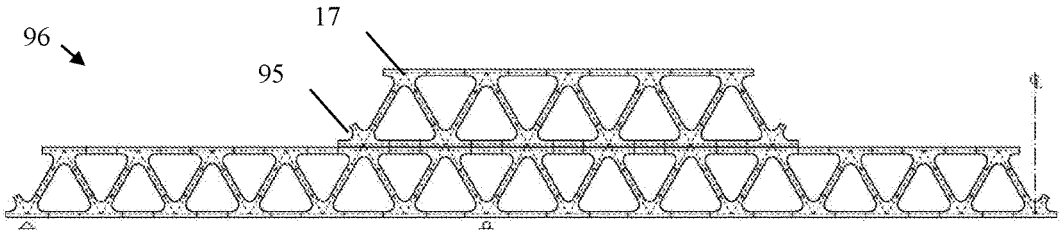
FIG. 19C is an elevation view of an example three-span continuous truss, based on the 4-noded modular truss joint of FIG. 19A and other 4-noded modular truss joints. Only half of the truss is shown, with symmetry assumed. Pin and roller restraints are shown.

FIG. 19A-B (elevation and side view respectively) shows an example 4-noded modular truss joint 95 with eccentric members, as compared to the 4-noded concentric modular truss joint 17 of FIG. 5. This is shown to demonstrate that modular truss joints do not need to join wide flange bodies 200 concentrically. FIG. 19C shows a possible configuration to form a three-span continuous bridge 96 using these joints and 4-noded concentric modular truss joints 17. The non-concentric modular truss joint allows for concentric connection between members of the top and bottom rows in the combined joint using two abutting 4-noded modular truss joints 95.

Figure 20A:
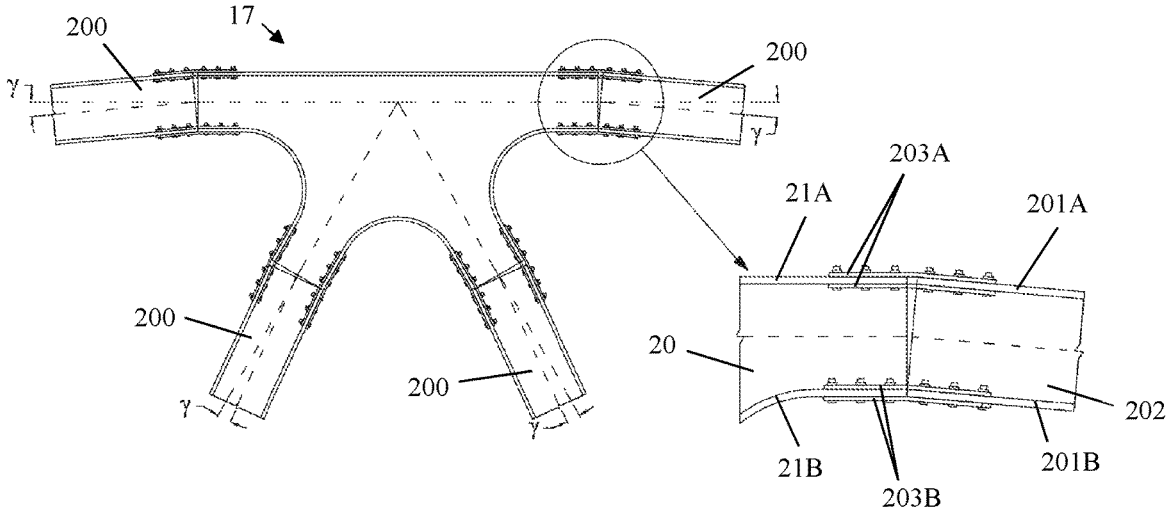
FIG. 20A is an elevation view of an example connection between an example 4-noded modular truss joint and angled wide flange bodies using bolted splice connections. Web splice connections are not shown for clarity.
Figure 20B:
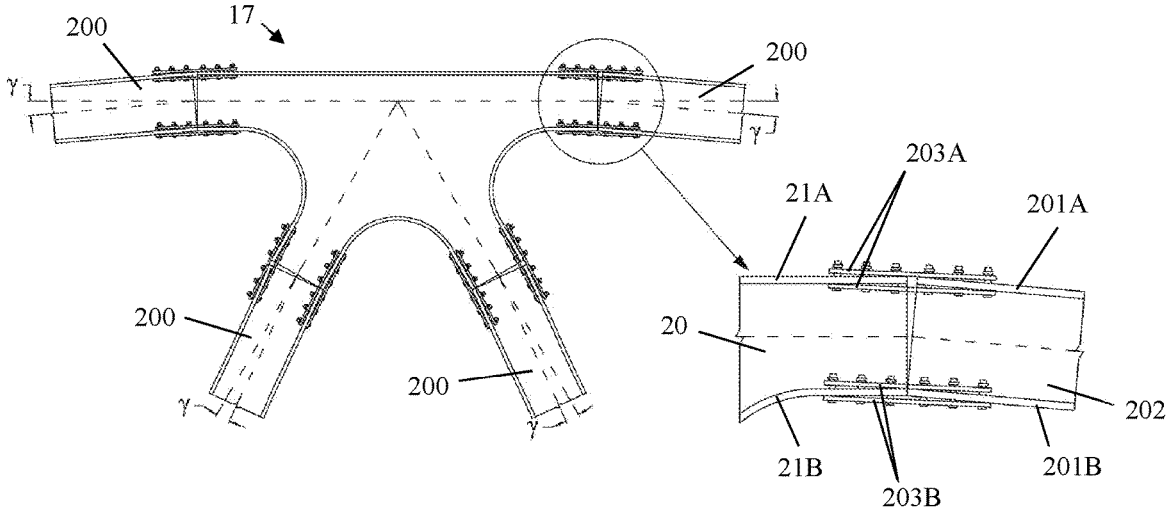
FIG. 20B is an elevation view of the example connection of FIG. 20A with initially straight splice plates. These can be bent to the configuration shown in FIG. 20A via bolt tightening.

The examples disclosed thus far feature modular truss joints, such as 4-noded modular truss joint 17, in which the modular truss joint is used to form constant-depth structures (sometimes including multiple rows). Another independent benefit of the joints according to the teachings of this disclosure is that splice connections 41 can include an internal bend, being thus angled or kinked, i.e. the chord/diagonal/other joint need not be connected concentrically with the connectors of the modular truss joint. In this way, variable-depth structures can be formed if joints are connected to diagonals/chords or to one another at angles γ. FIG. 20A shows angled connections between an example 4-noded modular truss joint 17 and four wide flange bodies 200. In FIG. 20A-B, angles are indicated by the symbol γ. These angles do not need to all have the same value. Here, the splice plates 203 between flanges are bent to achieve the angled connections. The web splice plates are not shown for clarity. The bends in these splice plates 203 could be created by pre-bending via a press brake or bending in the field via bolt tightening. FIG. 20B shows straight splice plates 203 prior to being bent in the field via bolt tightening, as for example, according to the methods disclosed in US Published Application No. 2017/0268186. If the angle is achieved by bolt tightening, it is recommended that bend angles γ not exceed 5 degrees to limit strains induced during the bending process. This example shows bolted double-shear splice connections 41, but other types of connections (e.g., welds, bolted single shear) could be used. A variety of variable-depth structures can be formed by these angled connections to achieve a variety of different shapes. This disclosure will provide examples for variable-depth simply supported truss bridges and variable-depth three-span continuous truss bridges made up of 4-noded modular truss joints. However, other types of variable-depth structures are possible. The following indicates a method for determining the coordinates of a planar truss if a user prescribes the joint lengths a, the straight lengths d, the joint angles θ, the height H [e.g., the depth at midspan for a simply supported bridge, the depth at the second support (see FIG. 21 for support numbering) for the three-span continuous bridge] and the various bend angles γ. Special cases for a simply supported and three-span continuous truss bridges are indicated. The following method is performed for the example 4-noded joint 17 shown in FIG. 5 but an analogous method could be used for other joint types.

Figure 22:
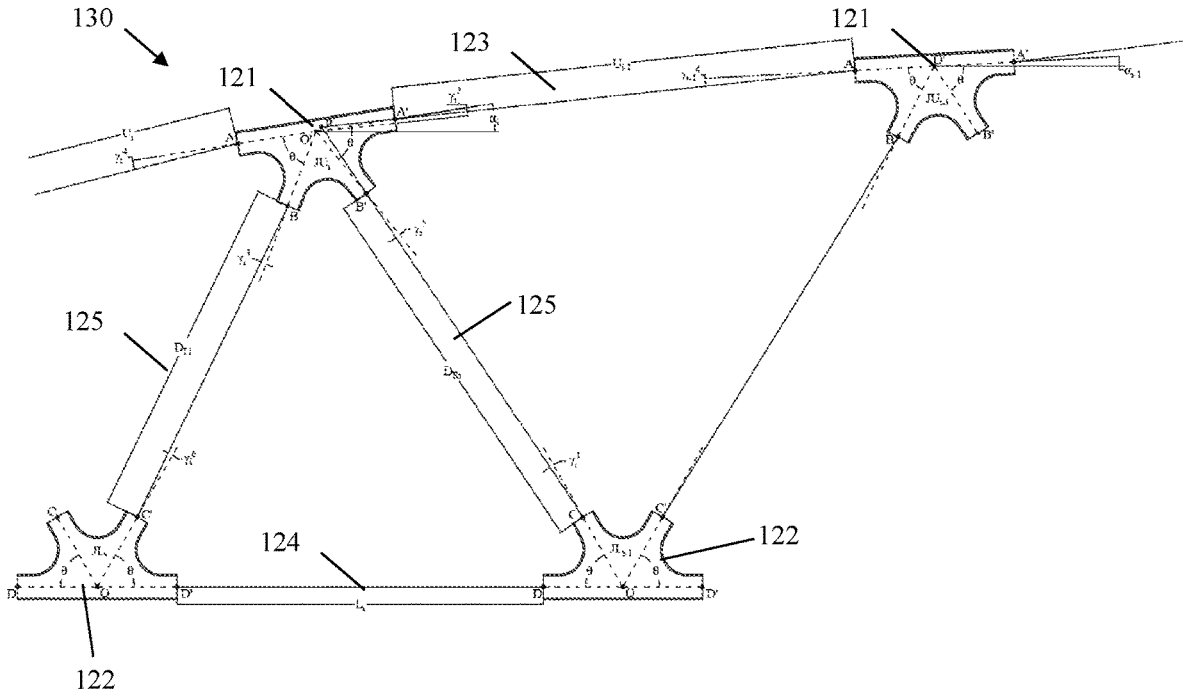
FIG. 22 is a partial elevation view of a variable-depth structure formed from example 4-noded modular truss joints and diagonals and chords.

In this method, upper chord joints 121 are labeled $JU_i$ and lower chord joints 122 are labeled $JL_i$ (see FIG. 22 for all index references for a generic part of a truss). The index 0 refers to midspan for simply supported bridge 120 (FIG. 23A) and to the second support for the three-span continuous bridge 160 (FIG. 23B). Upper chord beams 123 are indicated by $U_i$, lower chord beams 124 are indicated by $L_i$, diagonal beams 125 are indicated by $D_{Li}$ and $D_{Ri}$ [based on if they are to the left (L subscript) or right (R subscript) of the upper chord joint $JU_i$]. The following equations do not account for interference between the joints 121, 122, diagonals 125, and chords 123, 124. These equations focus only on the centerlines of each element. Interference can be avoided by cutting diagonals 125 and chords 123, 124 at angles or decreasing the straight length d of the connectors of the joints 121, 122.

To form a variable-depth structure 130, the diagonal beam $D_{Ri}$ is allowed to rotate about C of $JL_{i-1}$, by an angle $\gamma_i^1$. The upper chord joint $JU_i$, is allowed to rotate about its center O' by an angle $\gamma_i^2$ between the centerline of the chord connector A' of $JU_i$, and the centerline of the upper chord beam $U_{i-1}$. For $D_{Ri}$, to connect at B' of $JU_i$, there is an angle $\gamma_i^5$ between the centerlines of $D_{Ri}$ and the diagonal connector B' of $JU_i$. The upper chord beam $U_i$ is allowed to rotate an angle $\gamma_i^4$ between its centerline and the centerline of the chord connector A of $JU_i$. The diagonal beam $D_{Li}$ is allowed to rotate about B of $JU_i$ by an angle $\gamma_i^3$. For $D_{Li}$ to connect at C' of $JL_i$, there is an angle $\gamma_i^6$ between the centerlines of $D_{Li}$ and the diagonal connector C' of $JL_i$. These angles are related as follows:

$$\gamma_i^5=\gamma_i^1-\alpha_i, \quad \text{eq. (7)}$$

where $$\alpha_i=\alpha_{i-1}+\gamma_i^2+\gamma_{i-1}^4, \quad \text{eq. (8)}$$

and $$\gamma_i^6=\gamma_i^1+\gamma_i^3-\gamma_i^5, \quad \text{eq. (9)}$$

Throughout this disclosure, a clockwise rotation indicates a negative angle and a counterclockwise rotation indicates a positive angle. The following equations assume the angles are given in degrees. See FIG. 22 for all definitions.

Figure 23A:
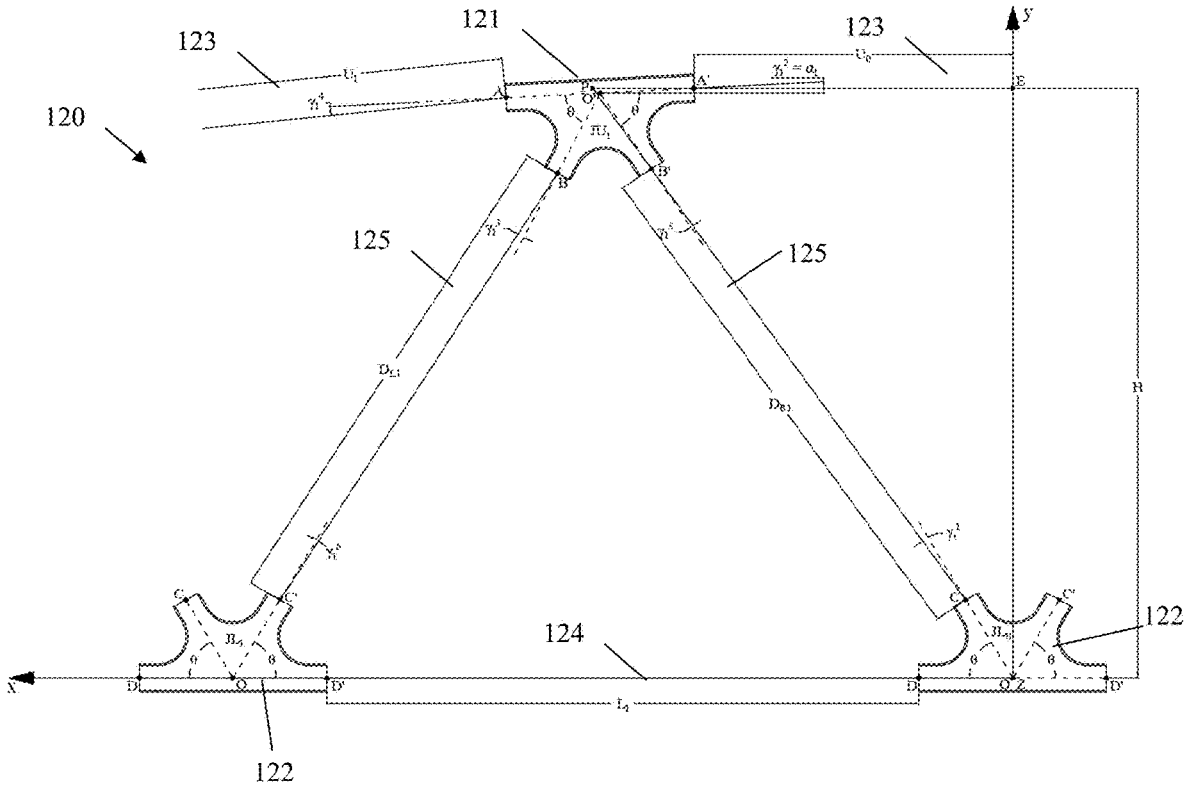
FIG. 23A is a partial elevation view of a variable-depth simply supported truss bridge formed from example 4-noded modular truss joints and diagonals and chords.
Figure 23B:
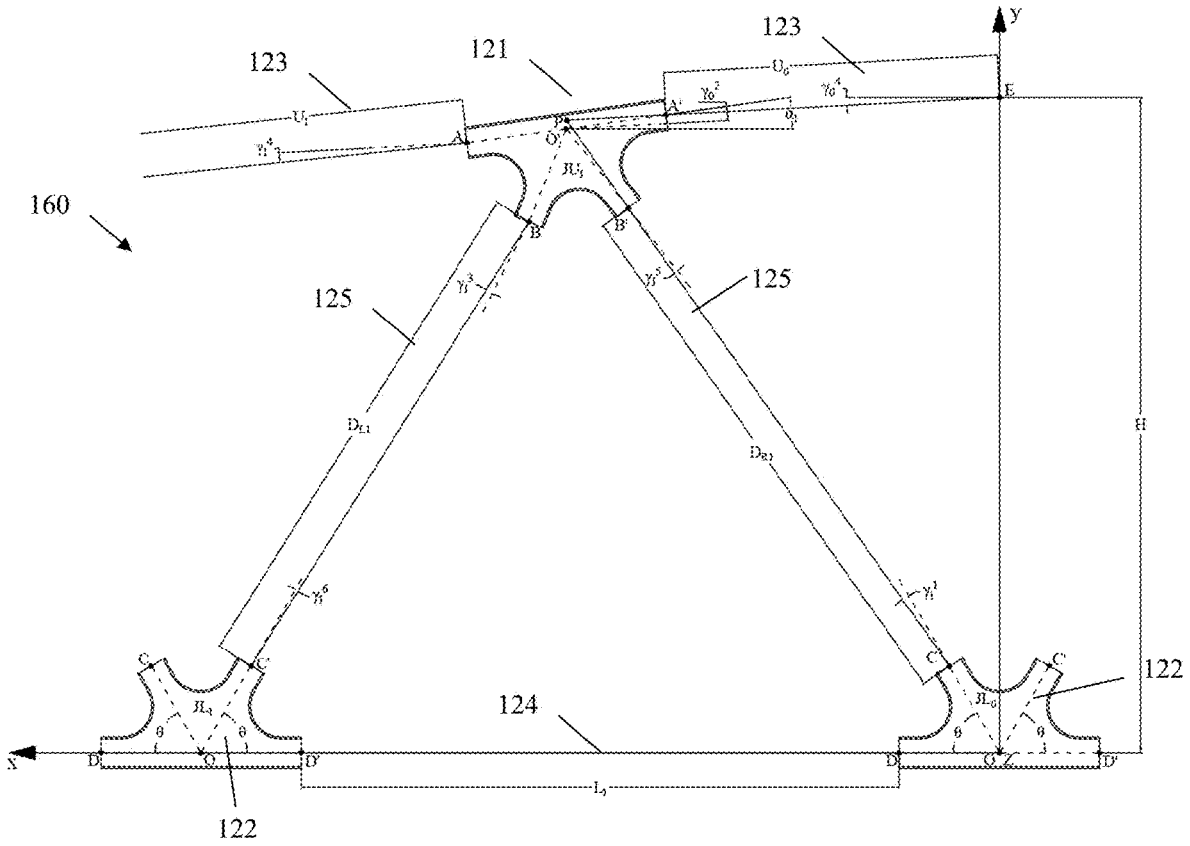
FIG. 23B is a partial elevation view of a variable-depth three-span continuous truss bridge formed from example 4-noded modular truss joints and diagonals and chords.

For a simply supported bridge with an odd number of modular truss joints in the lower chord, the center of the midspan lower chord modular truss joint ($JL_0$) is labeled 0 and is also considered the origin Z of the global coordinate system (FIG. 23A). It is assumed that the upper chord beam $U_0$ at midspan is horizontal and is centered at E at a vertical height H. Therefore, $\alpha_0=0$ and $\gamma_0^4=0$.

Figure 21:
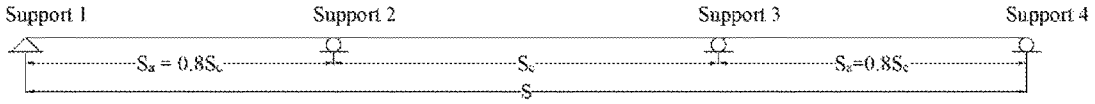
FIG. 21 is an elevation view of a three-span continuous bridge form. Truss members are not shown for clarity. Pin and roller restraints are shown.

For a three-span continuous bridge, the center of the lower chord modular truss joint ($JL_0$) is labeled 0 and is assumed to be at the second support (see FIG. 21 for support numbering). It is considered the origin Z of the global coordinate system (FIG. 23B). The upper chord beam $U_0$ is assumed to be at an angle $\gamma_0^4$ relative to the horizontal at point E with a height H. It is assumed that the upper chord beam $U_0$ is connected to an upper chord beam to the right of the second support (not pictured) at an equal angle. Also, $\alpha_0=0$.

The following develops general equations for the coordinates of the modular truss joints. See FIG. 24 for all variable definitions. In general, an upper chord modular truss joint ($JU_i$) is centered at O' at the horizontal and vertical distances ($x_t$ and $y_t$, respectively) measured from O of the lower chord modular truss joint ($JL_{i-1}$):

$$x_{t(i)}=e+e+e_{d1}+e_1 \quad y_{t(i)}=v+v_{d1}+v_1, \quad \text{eq. (10)}$$

The lengths e and v depend on the geometry of the modular truss joint and are determined by:

$$e=(a+d)\cos\theta \quad v=(a+d)\sin\theta, \quad \text{eq. (11)}$$

The joint length a is assumed to be the same for the diagonals and chords, such that $a=a_c=a_d$ (see FIG. 5 and attending discussion above). The joint is also assumed to be symmetric about its centerline. The straight length d of the chord and diagonal connectors is assumed to be the same for all four nodes of the joint, such that $d=d_c=d_d$ (see FIG. 5 and attending discussion above). It is also assumed that: $h=h_c=h_d$. These assumptions are made for this part of the disclosure, but the modular truss joint does not need to have these qualities. Analogous equations could be developed without these assumptions.

Figure 24:
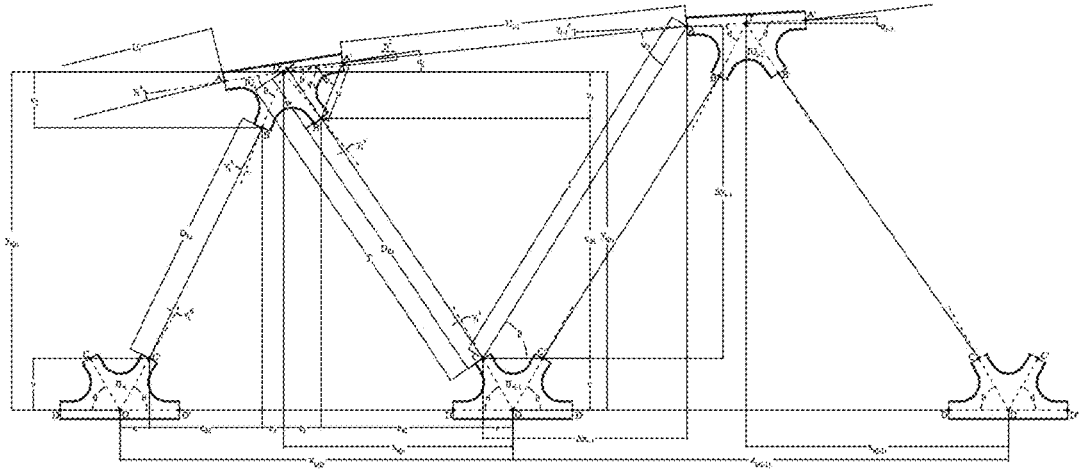
FIG. 24 is a partial elevation view of a variable-depth structure formed from example 4-noded modular truss joints and diagonals and chords.

The horizontal and vertical distances $e_{d1}$ and $v_{d1}$ can be calculated as follows:

$$e_{d1}=D_{Ri}\cos(\theta-\gamma_i^1)\ v_{d1}=D_{Ri}\sin(\theta-\gamma_i^1), \quad \text{eq. (12)}$$

where $D_{Ri}$ is the length of the diagonal beam and can be determined by:

$$D_{Ri}=T-w, \quad \text{eq. (13)}$$

where T and w are the distances indicated in FIG. 24. These distances relate to the location P in FIG. 24 which is the intersection of the line $D_{Ri}$ with the upper chord beam $U_{i-1}$. The length w is calculated from triangle B'PA' as follows:

$$w=\frac{u\sin\varphi}{\sin\psi_1}, \quad \text{eq. (14)}$$

where u is determined as follows from triangle B'O'A':

$$u=2(a+d)\sin\frac{\theta}{2}, \quad \text{eq. (15)}$$

The angle $\psi_1$ between the upper chord link beam $U_{i-1}$, and the diagonal link beam $D_{Ri}$:

$$\psi_1=\theta-\gamma_i^1+\gamma_{i-1}^4+\alpha_{i-1}, \quad \text{eq. (16)}$$

The angle φ between A'P and B'A' can be found by:

$$\varphi=\frac{(180-\theta)}{2}+\gamma_i^2, \quad \text{eq. (17)}$$

The length T can be calculated as follows:

$$T=\frac{f\sin\psi_2}{\sin\psi_1}, \quad \text{eq. (18)}$$

where the angle $\psi_2$ is:

$$\psi_2=\beta-\gamma_{i-1}^4-\alpha_{i-1}, \quad \text{eq. (19)}$$

and β is the angle between the horizontal and line CE as shown in FIG. 23 and is:

$$\beta=\tan^{-1}\left(\frac{\Delta y_{i-1}}{\Delta x_{i-1}}\right), \quad \text{eq. (20)}$$

where:

$$\Delta x_{i-1}=x_{b(i-1)}+e-x_{t(i-1)}-(a+d)\cos\alpha_{i-1}\ \Delta y_{i-1}=y_{t(i-1)}-v-(a+d)\sin\alpha_{i-1}, \quad \text{eq. (21)}$$

Note that $x_{b0}=0$, $x_{t0}=0$, and $y_{t0}=H$. Further, $\Delta x_0=e$. In general, the distance $x_b$ is:

$$x_{b(i)}=x_{t(i)}+e+e_2+e_{d2}, \quad \text{eq. (22)}$$

where $$e_2=(a+d)\cos(\theta+\gamma_i^1-\gamma_i^5), \quad \text{eq. (23)}$$

$$e_{d2}=\frac{y_{t(i)}-(a+d)\sin(\theta+\gamma_i^1-\gamma_i^5)-v}{\tan(\theta+\gamma_i^6)}, \quad \text{eq. (24)}$$

The length f can be calculated as follows:

$$f=\sqrt{\Delta x_{i-1}^2+\Delta y_{i-1}^2}, \quad \text{eq. (25)}$$

The horizontal and vertical distances $e_1$ and $v_1$ can be calculated as follows:

$$e_1=(a+d)\cos(\theta-\gamma_i^1+\gamma_i^5)\ v_1=(a+d)\sin(\theta-\gamma_i^1+\gamma_i^5), \quad \text{eq. (26)}$$

The coordinates of the center O of the lower chord joints $JL_i$ can be calculated as follows:

$$x_{l(i)}=x_{l(i-1)}+x_{b(i)}\ y_{l(i)}=0 \quad \text{eq. (27)}$$

Where $x_{l0}=0$. This assumes that all lower chord joints lie on a horizontal flat line. Other structures without this requirement could be developed by this strategy, using analogous equations. The coordinates of the center O' of the upper chord joints $JU_i$ can be calculated as follows:

$$x_{u(i)}=x_{l(i-1)}+x_{t(i)}\ y_{u(i)}=y_{t(i)} \quad \text{eq. (28)}$$

These equations relate to the left-side of the bridge, measured from the origin Z at midspan. For the simply supported bridge 120, it is assumed that it would be symmetric about the origin and that analogous equations would result for the other side of the bridge. For the three-span continuous bridge 160, it is assumed that analogous equations could be developed for the rest of the bridge.

This disclosure has demonstrated how the coordinates of a variable-depth planar truss comprised of 4-noded modular truss joints can be found if a user prescribes the joint length a, the straight length d, the joint angle θ, the height H, and the various bend angles γ. A user can select a joint length a to connect to a given set of diagonal and chord section sizes (e.g., W14 sections) using Equation (1). A joint angle θ can also be selected to achieve a reasonable span-to-depth ratio (see for example the earlier discussion leading to a choice of θ=60 for the constant depth trusses). With initial choices of a and θ, as well as a desired span length S and desired shape, a parametric study can then be performed to select the height H, the straight length d, and bend angles γ for optimized structural performance. For the parametric study performed in this disclosure, θ=60 and a=36.8754.

An example metric of structural performance used in this disclosure is susceptibility to in-plane buckling of compressive members (i.e., upper chord, lower chord, or diagonal beams which are in compression under any of the load cases considered). This is quantified as the highest magnitude $FL^2$ for any compressive member in a truss, where F is the force in the member and L is the unbraced length of the member (measured from the center of a joint to the center of joint, as it is assumed that lateral bracing will be provided at each modular truss joint). This is chosen to relate to Euler buckling. The force in members are calculated using the direct stiffness method, considering only a single plane of the structure. When comparing different trusses, the truss with the lowest value of this metric would have the lowest susceptibility to in-plane buckling and would therefore be preferred.

The parametric study calculated this structural performance metric $FL^2$ for varying combinations of the height H and the straight length d for both the simply supported and the three-span continuous bridges. For a given combination H and d the coordinates of all joints are found which are closest to a specified desired shape. More specifically, each angle γ is allowed to vary within a prescribed range. The combination of angles γ that gives coordinates for each upper chord joint closest to the desired depths y at a distance x from the origin Z are selected. With this method, the coordinates of upper chord and lower chord joints are found progressively moving out from the origin to ultimately achieve a desired span length. To achieve a proper restraint at the ends, it is required that the variable-depth structures end with a lower chord joint. This process ends when a lower chord joint is within a reasonable distance to achieve a desired span length.

Figure 25:
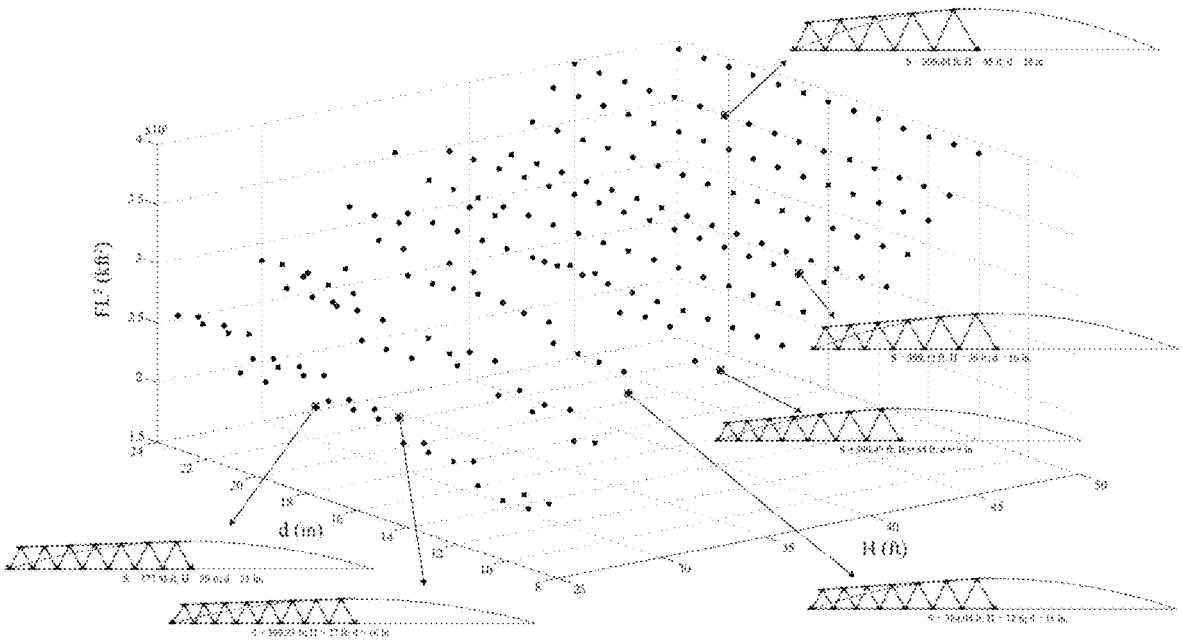
FIG. 25 is a graph showing the results of an example parametric study investigating forms for variable-depth simply supported truss bridges.
Figure 26:
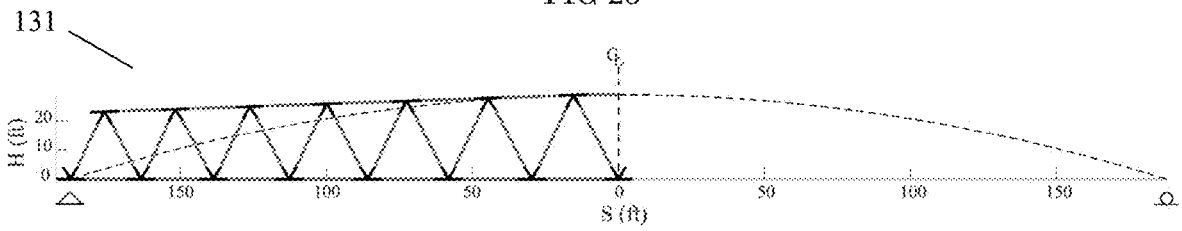
FIG. 26 shows an example variable-depth simply supported truss bridge with an approximate 375 ft span in an elevation view. Only half of the bridge is shown, with symmetry assumed.

In the example parametric study in this disclosure, a simply supported bridge with an approximate span of 400 ft is considered (i.e., a span length of at least 375 ft). The depth H at midspan ranges between 25 and 50 ft in increments of 1 ft and the straight length d ranges between 9 and 24 in. in increments of 1 in. The desired shape of the simply supported bridge follows the bending moment diagram of a beam subjected to a uniformly distributed load. The shape of the bending moment diagram is scaled to have the desired height H at midspan. FIG. 25 shows the values of structural performance metric $FL^2$ for each combination of H and d. Truss forms for selected options are shown (gray indicates the diagonals and chords, black indicates the modular truss joint, dashed lines indicate the desired shape). FIG. 26 shows the variable-depth simply supported truss 131 corresponding to the lowest $FL^2$ metric (gray indicates the diagonals and chords, black indicates the modular truss joint, dashed lines indicate the desired shape). Note that this parametric study only considered simply supported trusses with an odd number of joints in the lower chord. Analogous studies could be performed for simply supported trusses with an even number of joints in the lower chord.

Figure 27:
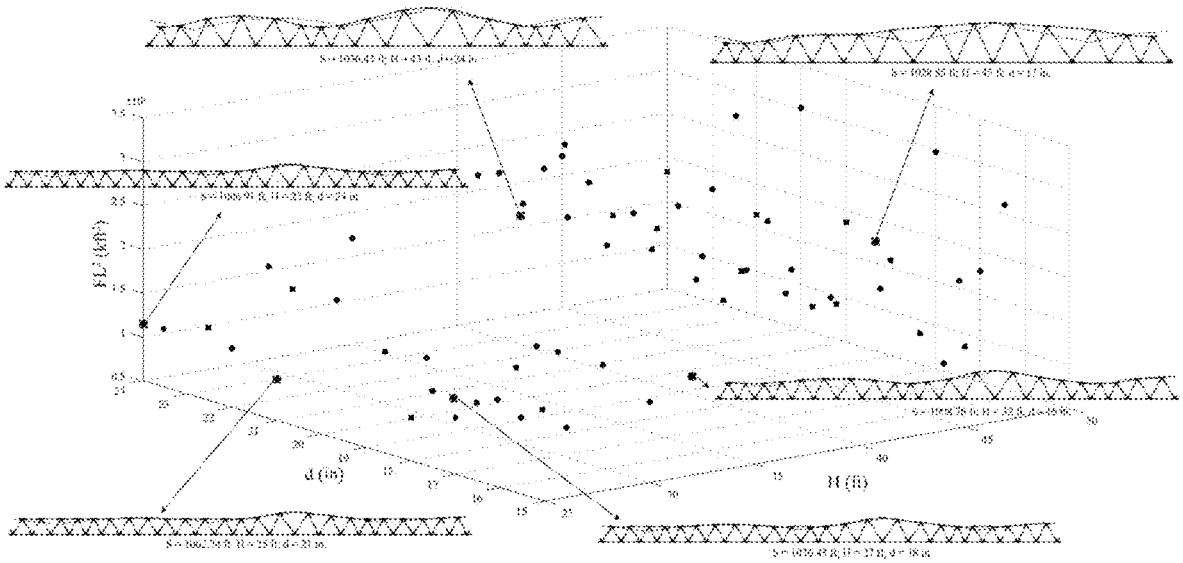
FIG. 27 is a graph showing the results of an example parametric study investigating forms for variable-depth three-span continuous truss bridges.
Figure 28:
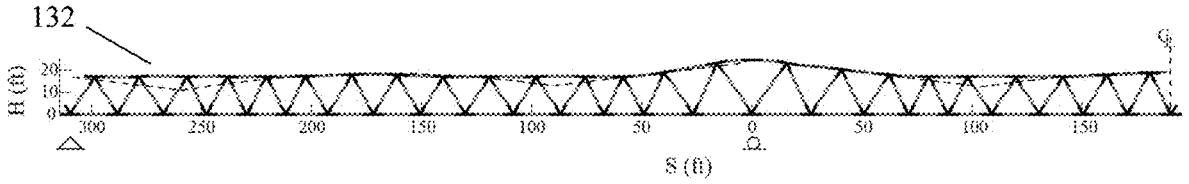
FIG. 28 shows an example variable-depth three-span continuous truss bridge with an approximate total span of 1000 ft in an elevation view. Only half of the bridge is shown, with symmetry assumed. Restraints are not symmetric and would include one pin and three rollers as shown in FIG. 21.

Another example parametric study in this disclosure considers a three-span continuous bridge with an approximate center span of $S_c$ of 400 ft (i.e., a span length of at least 375 ft) and two outer spans $S_a$ of approximately 320 ft each (i.e., a span length of at least 295 ft, calculated as 80% of the center span $S_c$; See FIG. 21). The depth H at the second support ranges between 25 and 50 ft in increments of 1 ft and the straight length d ranges between 9 and 24 in. in increments of 1 in. The desired shape follows a combined moment and shear diagram with a uniformly distributed load (a) over the entire bridge, (b) over half of the entire bridge, (c) on any of the three spans, and (d) on any of the two spans. The highest values of the moment and shear demand are calculated (separately) for each of these load scenarios. Each is then scaled to have a height H at the second support. The larger value for each is taken as the desired shape along the length of the bridge. FIG. 27 shows the values of structural performance metric $FL^2$ for each combination of H and d considered. Truss forms for selection options are shown (gray indicates the diagonals/chords, black indicates the modular truss joint, dashed lines indicate the desired shape). FIG. 28 shows the variable-depth three-span continuous truss 132 corresponding to the lowest $FL^2$ metric (gray indicates the diagonals/chords, black indicates the modular truss joint, dashed lines indicate the desired shape).

For both bridges 131, 132, the distributed load is one lane of vehicular live load taken as 0.64 kips/ft per bridge design code. It was assumed that there are two planes of trusses to carry this load, therefore its magnitude was divided in half. Additional lanes of traffic or different magnitudes of loads could be considered using an analogous approach.

If the bend angles are achieved via bolt tightening initially flat plates, it is recommended that these angles not exceed 5 degrees in either direction. In the examples shown in this disclosure, bend angles γ range between −5 and 5 degrees with increments of 1 degree are considered. Other ranges and increments are also possible.

Preliminary design of the variable-depth simply supported truss bridge 131 of FIG. 26 and the variable-depth three-span continuous truss bridge 132 of FIG. 28 was performed. More specifically, three-dimensional linear (eigenvalue) buckling analyses were performed for each bridge 131, 132 under dead load, superimposed dead load of the deck (assumed to be 1.125 kips/ft for a lightweight deck), distributed live load (i.e., 0.64 kips/ft to represent one lane of vehicular traffic per bridge design code), and wind loads (assumed to be 50 psf). For the simply supported bridge 131, live load was considered to act over the (a) entire bridge and (b) half of the bridge. For the three-span continuous bridge 132, the live load was considered to act (a) over the entire bridge, (b) over half of the entire bridge, (c) on any of the three spans, and (d) on any of the two spans. These example bridges 131, 132 are designed to carry only a single lane of vehicular traffic, but could be designed to include additional lanes of traffic. To achieve a 12 ft design lane width, the bridges are 15 ft wide in the transverse direction. The simply supported bridge 131 is restrained with roller boundary conditions on side (i.e., free rotation in all directions, free translation along the longitudinal axis of the bridge, translation restrained in all other directions) and pinned boundary conditions on the other side (i.e., free rotation in all directions, translation restrained in all directions). The three-span continuous bridge 132 is restrained with one pin and three rollers as shown in FIG. 21. Wide flange sections for the diagonals and chords, as well as transverse lateral bracing and transverse floor beams, were selected to achieve buckling factors greater than or equal to 2.5. W14 sections were targeted so that the same modular truss joint (with a web height h based on W14 sections) could be used for both bridges. Note that this preliminary design did not explicitly model the modular truss joint. The model includes only frame elements concentrically joined at nodes (where the modular truss joint would be) for simplicity. All frame elements are moment connected. Further detailed finite element analysis of the modular truss joint would be performed in later design stages.

Figure 29A:
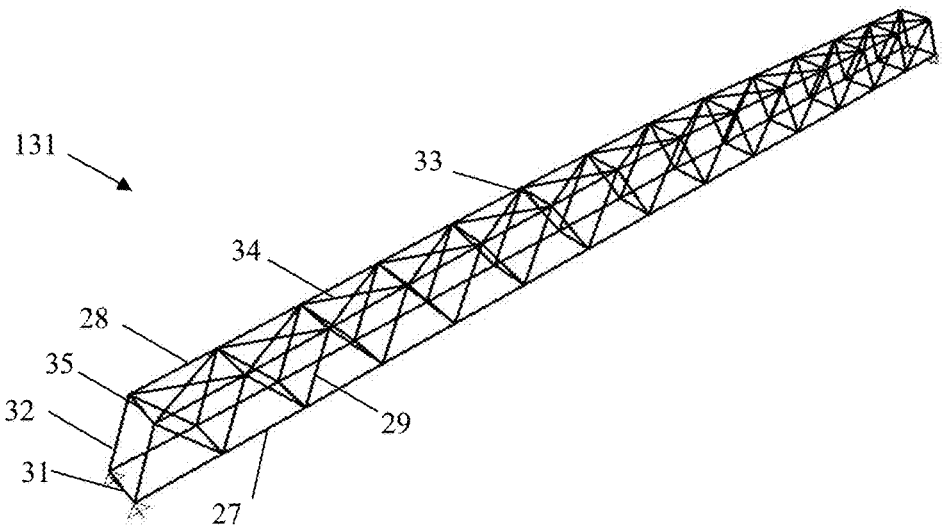
FIG. 29A is an isometric view of the example variable-depth simply supported truss bridge in FIG. 26.
Figures 29B, 29C:
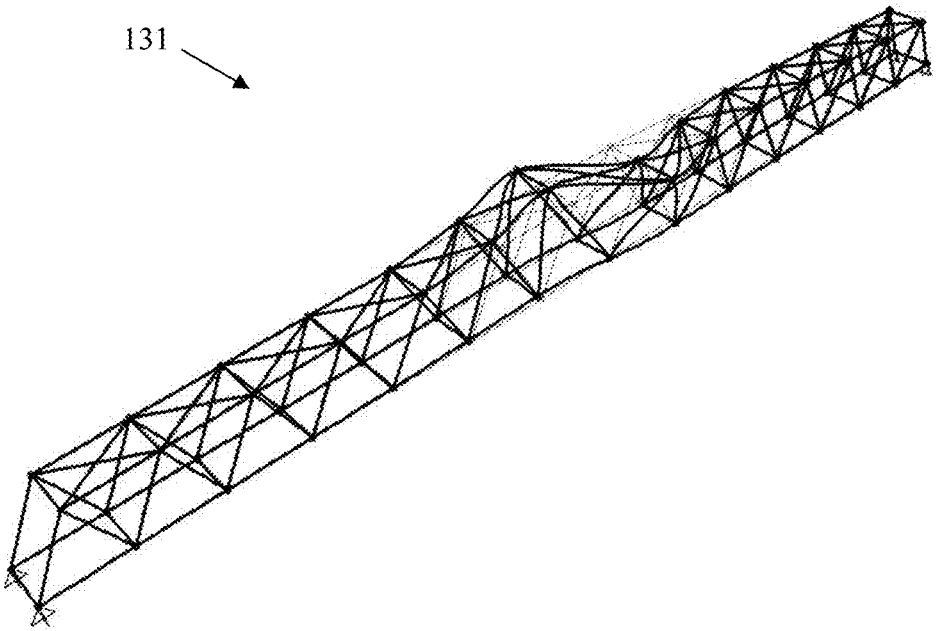
FIG. 29B is an isometric view of the buckled shape of the example variable-depth simply supported truss bridge in FIG. 26.
FIG. 29C is a table showing the sections sizes, buckling factor, and self-weight of the example variable-depth simply supported truss bridge in FIG. 26.

FIG. 29A shows an isometric view of the variable-depth simply support truss bridge 131 of FIG. 26. FIG. 29B shows the buckled shape corresponding to the smallest buckling factor. FIG. 29C shows the section sizes selected for the upper chord 28, lower chord 27, diagonals 29, the transverse floor beams 31, the transverse lateral bracing 33, and cables providing x-shaped lateral bracing 34. The diagonals in the portal region 32 have the same section size as the upper chord 28. The transverse lateral bracing in the portal region 35 also have the same section size as the upper chord 28.

Figure 30A:
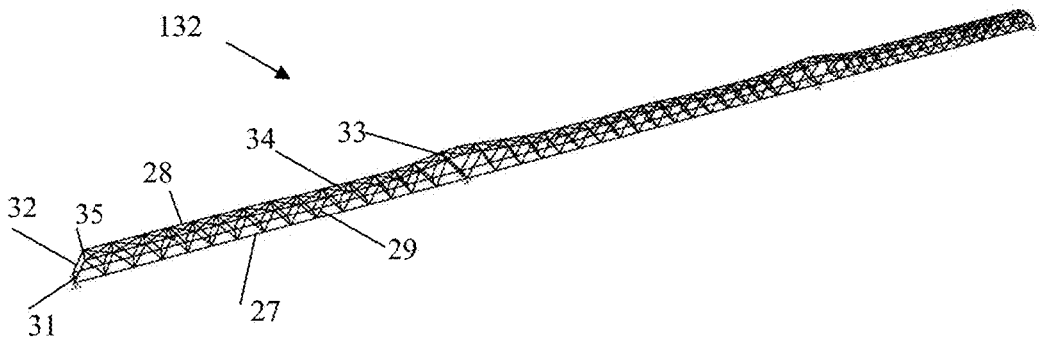
FIG. 30A is an isometric view of the example variable-depth three-span continuous truss bridge in FIG. 28.
Figure 30B:
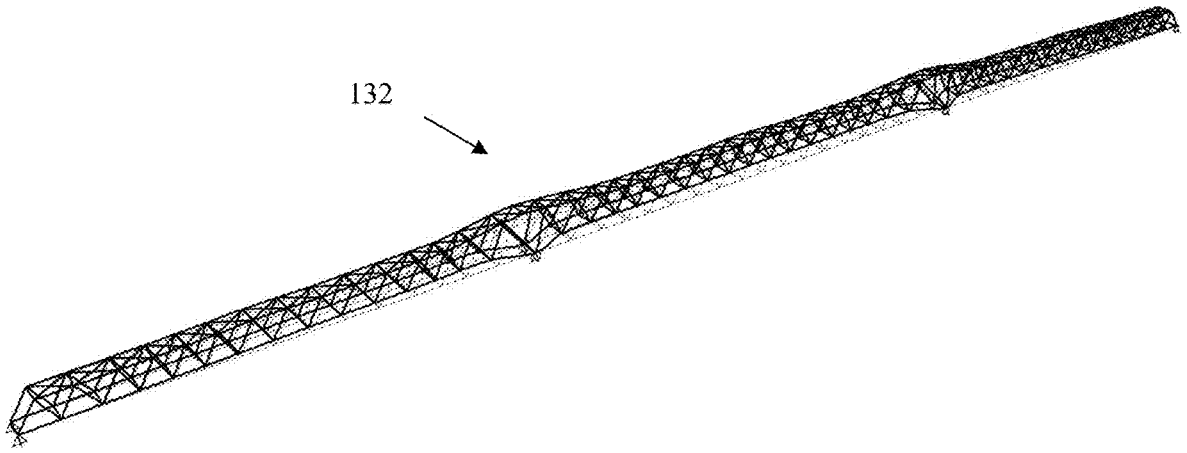
FIG. 30B is an isometric view of the buckled shape of the example variable-depth three-span continuous truss bridge in FIG. 28.

FIG. 30A shows an isometric view of the variable-depth three-span continuous truss bridge 132 of FIG. 28. FIG. 30B shows the buckled shape corresponding to the smallest buckling factor. FIG. 30C shows the section sizes selected for the upper chord 28, lower chord 27, diagonals 29, the transverse floor beams 31, the transverse lateral bracing 33, and cables providing x-shaped lateral bracing 34. The diagonals in the portal region 32 have the same section size as the upper chord 28. The transverse lateral bracing in the portal region 35 also have the same section size as the upper chord 28.

Figure 31C:
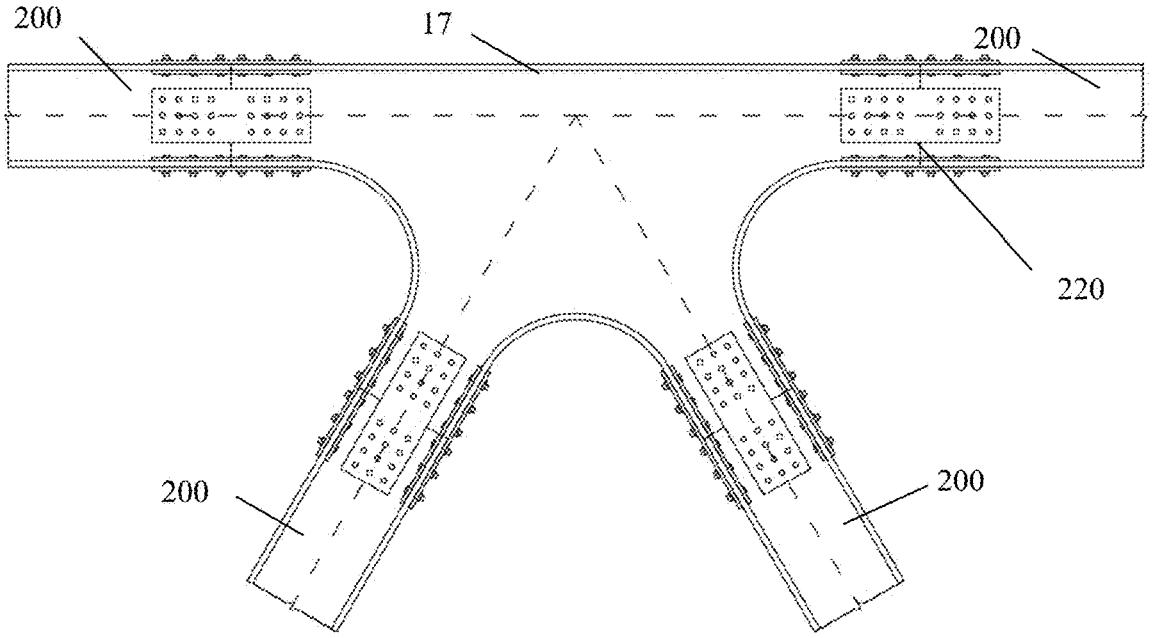
FIG. 31C is an elevation view of the example configuration in FIG. 31A-B.

FIG. 31A is an example demonstrating how a modular truss joint 17 can be connected to wide flange bodies 200 at angles in plan view. Here a bent splice plate 220 would connect the webs to achieve the angled connection (FIG. 31B). FIG. 31C is an elevation view of that configuration.

Figure 32:
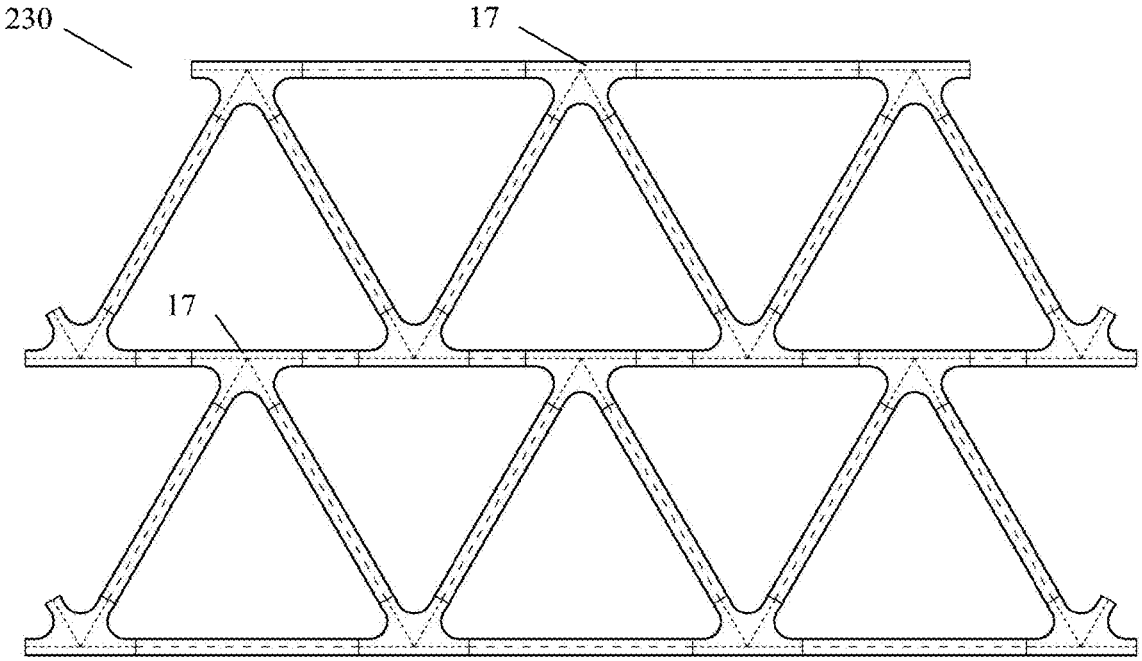
FIG. 32 is an elevation view of an example configuration using an example 4-noded modular truss joint.

FIG. 32 is an elevation drawing of an example configuration 230 using the 4-noded modular truss joint 17. In this example arrangement, the joints are not aligned. This would result in a more flexible structure which could be used as a compliant mechanism.

Examples shown in this disclosure use diagonal and chord beams comprised of wide flange cross-sections. However, other cross-sections (e.g., WT, HSS sections) for the beams of diagonal 29, lower chord 27, upper chord 28 are possible. The modular truss joints, such as 4-noded modular truss joint 17, can also be used without diagonal or chord beams. Examples shown in this disclosure use straight diagonal and chord beams. However, diagonal and chord beams could be curved, kinked, polygonal, or any other geometric shape or curve.

Examples shown in this disclosure use double-shear bolted splice connections between the modular truss joints and the diagonal/chord beams. However, other types of connections (e.g., single-shear bolted splice connections, welds) are possible.

Examples shown in this disclosure use steel as the material for both the modular truss joints and diagonal/chord beams. However, other materials (e.g., glass or carbon fiber reinforced polymers, wood, aluminum) could be used.

We claim:

1. A modular truss joint comprising:

a web plate;

a first connector having a first web integrally formed as a portion of the web plate having a first connector length;

a second connector having a second web integrally formed as a portion of the web plate having a second connector length, positioned at a first connector angle with respect to the first connector;

a third connector having a third web integrally formed as a portion of the web plate having a third connector length, positioned at a second connector angle with respect to the second connector;

a first continuous flange located on a first region on a periphery of the modular truss joint;

a second continuous flange located on a second region on the periphery of the modular truss joint; and a third continuous flange located on a third region on the periphery of the modular truss joint;

wherein each of the first, second, and third continuous flanges are oriented transversely to and form a t-shaped cross-section with at least one of the first web, second web, or third web;

wherein the first, second, and third connectors are configured to form a modular structure by connecting to at least one wide flange body to form a moment resisting connection whereby the modular truss joint resists flexure of the modular structure.

2. The modular truss joint of claim 1 wherein at least one of the first, second, and third connectors are connected to the at least one wide flange body via a splice connection.

3. The modular truss joint of claim 1 wherein the at least one wide flange body is a first second, or third connector of an additional modular truss joint.

4. The modular truss joint of claim 1 wherein two of the wide flange bodies are a chord with a chord web and two chord flanges; and a diagonal with a diagonal web and two diagonal flanges.

5. The modular truss joint of claim 2 wherein the splice connection further comprises:

the first, second, or third continuous flange are connected to a first flange of an adjacent wide flange body on one side of the first, second, or third connector in single or double shear;

the first, second, or third continuous flange are connected to a second flange of the adjacent wide flange body on an opposite side of the first, second, or third connector in single or double shear; and the first, second, or third web of the first, second, or third connector are connected to a web of an adjacent wide flange body in single or double shear.

6. The modular truss joint of claim 5 wherein the splice connection further comprises at least one splice plate positioned adjacent to and simultaneously parallel to at least one surface on each of the at least two members being connected; and a plurality of fasteners extending through the webs, flanges or both of the two members such that the splice plate and the joint and the wide flange body are joined.

7. The modular truss joint of claim 1 wherein the modular truss joint and the wide flange body are aligned in a linear relationship by the moment resisting connection between the first, second, or third connector and the wide flange body.

8. The modular truss joint of claim 1 wherein the wide flange member is aligned at an angle to the first, second, or third connector by the moment resisting connection between the first, second, or third connector and the wide flange member.

9. The modular truss joint of claim 8 wherein the angle is out of the plane of the modular truss joint.

10. The modular truss joint of claim 8 wherein the angle is in the plane of the modular truss joint.

11. The modular truss joint of claim 1 wherein the first, second, and third connectors of the modular truss joint are joined concentrically.

12. The modular truss joint of claim 1 wherein the first, second, and third continuous flanges, the first, second, and third web, and the web plate are steel.

13. The modular truss joint of claim 12 wherein the first, second, and third continuous flanges are continuously welded to first, second, and third webs, and the web plate.

14. The modular truss joint of claim 12 in which the continuous flanges are cold bent.

15. The modular truss joint of claim 1 further comprising a fourth connector having a fourth web integrally formed as a portion of the web plate having a fourth connector length, positioned at a third connector angle with respect to the third connector; and a fourth continuous flange located on a fourth region of the modular truss joint on the periphery of the modular truss joint, wherein the fourth continuous flange is oriented transversely to the first web, second web, third web, or fourth web.

16. The modular truss joint of claim 1 wherein at least one of the first, second, and third connectors has the same cross-section as the wide flange body which it is connecting.

17. The modular truss joint of claim 1, wherein the structure is one of following: a bridge, roof structure, building frame component, or a grid shell.

18. A plane for forming a modular structure having a first end and a second end comprising:

a plurality of primary joints, each primary joint comprising:

a web plate;

a first connector having a first web integrally formed as a portion of the web plate having a first connector length;

a second connector having a second web integrally formed as a portion of the web plate having a second connector length, positioned at a first connector angle with respect to the first connector;

a third connector having a third web integrally formed as a portion of the web plate having a third connector length, positioned at a second connector angle with respect to the second connector;

a first continuous flange located on a first region on a periphery of the primary joint;

a second continuous flange located on a second region on the periphery of the primary joint; and a third continuous flange located on a third region on the periphery of the primary joint;

wherein the first, second, and third continuous flange are oriented transversely to the first, second, or third web;

wherein the first, second, and third connectors are configured to form a modular structure by connecting to at least one wide flange body to form a moment resisting connection whereby the primary joint resists flexure of the modular structure;

wherein the plurality of primary joints are arranged in an upper row in one orientation and a lower row in another orientation;

a plurality of upper chords having an upper chord length connecting the first connector of each primary joint in the upper row to the third connector of the adjacent primary joint in the upper row;

a plurality of lower chords having a lower chord length connecting the first connector of each primary joint in the lower row to the third connector of the adjacent primary joint in the lower row; and a plurality of diagonal members having a diagonal length connecting the second connector of each primary joint in the upper row to the second connector of the opposite joint in the upper row;

wherein the two primary joints immediately adjacent to the first end of the plane are a first penultimate primary joint in the upper row and a second penultimate primary joint in the lower row and the two primary joints immediately adjacent to the second end of the plane are a third penultimate primary joint in the upper row and a fourth penultimate primary joint in the lower row;

a first terminal joint positioned on the first end of the plane, the first terminal joint including a first terminal connector of the first terminal joint connected to the third connector of a first penultimate primary joint and a second terminal connector of the first terminal joint connected to a first connector of a second penultimate primary joint; and a second terminal joint positioned on the second end of the plane, the second terminal joint including a first terminal connector of the second terminal joint connected to the first connector of a third penultimate primary joint and a second terminal connector of the second terminal joint connected to a third connector of a fourth penultimate primary connector;

wherein the first and second ends of the modular plane are restrained and the first end of the plane is operably connected to the first terminal joint, and the second end of the plane is operably connected to the second terminal joint.

19. The modular plane of claim 18, wherein the upper chord length, the lower chord length, and the diagonal chord length can be varied to form a plurality of modular structures with variable spans, depths, or joint spacings.

20. The modular plane of claim 18, wherein the primary joints, the terminal joints, the upper chords, the diagonals, and lower chords are constructed of steel.

21. The modular plane of claim 18, further comprising a plurality of medial truss joints arranged in an intermediate row between the upper row and the lower row, each medial truss joint comprising:

an intermediate web plate;

a first intermediate connector having a first intermediate web integrally formed as a portion of the intermediate web plate;

a second intermediate connector having a second intermediate web integrally formed as a portion of the intermediate web plate;

a third intermediate connector, connector having a third intermediate web integrally formed as a portion of the intermediate web plate; and a fourth intermediate connector having a fourth intermediate web integrally formed as a portion of the intermediate web plate;

a first intermediate continuous flange located on a first region of the medial truss joint on a periphery of the medial truss joint;

a second intermediate continuous flange located on a second region of the medial truss joint on the periphery of the medial truss joint;

a third intermediate continuous flange located on a third region of the medial truss joint on the periphery of the medial truss joint; and a fourth intermediate continuous flange located on a fourth region of the medial truss joint on the periphery of the medial truss joint;

wherein the first, second, third, and fourth intermediate continuous flanges are oriented transversely to the first, second, third, or fourth intermediate web;

wherein for each medial truss joint:

the first intermediate connector connected by a member to the third intermediate connector of an adjacent medial joint in the intermediate row;

the second intermediate connector connected by a diagonal member to the second connector of an adjacent primary joint in the upper row;

a fourth intermediate connector connected by a diagonal member to the second connector of an adjacent primary joint in the lower row.

22. The modular plane of claim 21 wherein each of the primary joints further comprises:

a fourth connector having a fourth web integrally formed as a portion of the web plate having a fourth connector length, positioned at a third connector angle with respect to the third connector; and a fourth continuous flange located on a fourth region on the periphery of the primary joint;

wherein the fourth connector of a primary joint in the lower row is connected by a diagonal member to the fourth connector of an adjacent primary joint in the upper row.

23. The modular plane of claim 22, wherein the medial joints further comprise:

a fifth intermediate connector having a fifth intermediate web integrally formed as a portion of the intermediate web plate, wherein the fifth intermediate connector is connected by a diagonal member to the fourth connector of an adjacent primary joint in the upper row, a sixth intermediate connector having a sixth intermediate web integrally formed as a portion of the intermediate web plate, wherein the sixth intermediate connector is connected by a diagonal member to the fourth connector of an adjacent primary joint in the lower row;

a fifth intermediate continuous flange located on a fifth region on the periphery of the medial truss joint; and a sixth intermediate continuous flange located on a sixth region on the periphery of the medial truss joint.

24. The modular plane of claim 18, wherein the upper chords, the diagonals, and the lower chords are rolled wide flange sections.

25. The modular plane of claim 24 wherein the rolled wide flange sections are W12 or W14 sections.

26. The modular truss joint of claim 18 further comprising a fourth connector having a fourth web integrally formed as a portion of the web plate having a fourth connector length, positioned at a third connector angle with respect to the third connector; and a fourth continuous flange located on a fourth region on the periphery of the primary joint, wherein the fourth continuous flange is oriented transversely to the first web, second web, third web, or fourth web.

27. A modular truss bridge comprising:

a first bridge plane having a first end and a second end;

a second bridge plane having a first end and a second end;

a plurality of lateral braces extending between the first bridge plane and the second bridge plane;

a deck supported by the first and second bridge planes;

wherein the first and second ends of the first bridge plane and the first and second ends of the second bridge plane are restrained; and wherein each of the first and second bridge planes comprises:

a plurality of primary joints, each primary joint comprising:

a web plate;

a first connector having a first web integrally formed as a portion of the web plate having a first connector length;

a second connector having a second web integrally formed as a portion of the web plate having a second connector length, positioned at a first connector angle with respect to the first connector;

a third connector having a third web integrally formed as a portion of the web plate having a third connector length, positioned at a second connector angle with respect to the second connector;

a first continuous flange located on a first region on a periphery of the primary joint;

a second continuous flange located on a second region on the periphery of primary joint; and a third continuous flange located on a third region on the periphery of the primary joint;

wherein the first, second, and third continuous flange are oriented transversely to the first, second, or third web;

wherein the first, second, and third connectors are configured to form a modular structure by connecting to at least one wide flange body to form a moment resisting connection whereby the primary joint resists flexure of the modular structure;

wherein the plurality of primary joints are arranged in an upper row in one orientation and a lower row in another orientation;

a plurality of upper chords having an upper chord length connecting the first connector of each primary joint in the upper row to the third connector of the adjacent primary joint in the upper row;

a plurality of lower chords having a lower chord length connecting the first connector of each primary joint in the lower row to the third connector of the adjacent primary joint in the lower row; and a plurality of diagonal members having a diagonal length connecting the second connector of the joint in the upper row to the second connector of the opposite joint in the upper row;

wherein the two primary joints immediately adjacent to the first end of the bridge plane are a first penultimate primary joint in the upper row and a second penultimate primary joint in the lower row and the two primary joints immediately adjacent to the second end of the bridge plane are a third penultimate primary joint in the upper row and a fourth penultimate primary joint in the lower row;

a first terminal joint positioned on the first end of the bridge plane, the first terminal joint including a first terminal connector of the first terminal joint connected to the third connector of a first penultimate primary joint and a second terminal connector of the first terminal joint connected to a first connector of a second penultimate primary connector; and a second terminal joint positioned on the second end of the bridge plane, the second terminal joint including a first terminal connector of the second terminal joint connected to the first connector of a third penultimate primary joint and a second terminal connector of the second terminal joint connected to a third connector of a fourth penultimate primary connector;

wherein the first end of the bridge plane is operably connected to the first terminal joint, and the second end of the bridge plane is operably connected to the second terminal joint.

* * * * *